US008577226B2

(12) United States Patent
Ozaki et al.

(10) Patent No.: US 8,577,226 B2
(45) Date of Patent: Nov. 5, 2013

(54) DETACHABLE BODY AND IMAGE FORMING APPARATUS

(75) Inventors: Isao Ozaki, Kanagawa (JP); Masaru Furuoya, Kanagawa (JP); Toru Hamuro, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 325 days.

(21) Appl. No.: 12/987,447

(22) Filed: Jan. 10, 2011

(65) Prior Publication Data

US 2011/0318056 A1 Dec. 29, 2011

(30) Foreign Application Priority Data

Jun. 28, 2010 (JP) ..... P2010-146648

(51) Int. Cl.
*G03G 15/00* (2006.01)

(52) U.S. Cl.
USPC ..... 399/12; 399/120; 399/262

(58) Field of Classification Search
USPC ..... 399/9, 13, 107, 110, 119, 120, 252, 399/258–263
See application file for complete search history.

(56) References Cited

U.S. PATENT DOCUMENTS

| | | | | |
|---|---|---|---|---|
| 7,447,470 | B2 | 11/2008 | Lee | |
| 7,680,444 | B2 * | 3/2010 | Kaiho | 399/260 |
| 7,822,371 | B2 * | 10/2010 | Taguchi et al. | 399/262 |
| 7,962,064 | B2 * | 6/2011 | Asai | 399/120 |

FOREIGN PATENT DOCUMENTS

| | | |
|---|---|---|
| JP | 2007-4164 | 1/2007 |

* cited by examiner

*Primary Examiner* — Hoan Tran
(74) *Attorney, Agent, or Firm* — Sughrue Mion, PLLC

(57) ABSTRACT

A detachable body includes: a detachable body main body that is to be attached to an attachment/detachment subject apparatus in a detachable manner, the detachable main body having an internal space and a connection hole which connects the internal space and an external space; and an opening/closing member that is attached to the detachable body main body, the opening/closing member being movable between an opening position where the connection hole is exposed and a closing position where the connection hole is closed. The opening/closing member includes: an opening/closing member main body that is curved parallel with a movement direction of the opening/closing member between the opening position and the closing position; and a plane portion that has a flat surface, the plane portion being formed in an outer surface of the opening/closing member main body.

9 Claims, 27 Drawing Sheets

DETACHABLE BODY AND IMAGE FORMING APPARATUS

CROSS-REFERENCE TO RELATED APPLICATIONS

This application is based on and claims priority under 35 USC 119 from Japanese Patent Application No. 2010-146648 filed on Jun. 28, 2010.

BACKGROUND

1. Technical Field

The present invention relates to a detachable body and an image forming apparatus.

2. Related Art

There is proposed an image forming apparatus that is equipped with a developer container for supplying developer to replenish toner that has been consumed by an image forming operation or a detachable body that can be detached (and replaced) to replace or repair an expendable member.

SUMMARY

According to an aspect of the invention, a detachable body includes: a detachable body main body that is to be attached to an attachment/detachment subject apparatus in a detachable manner, the detachable main body having an internal space and a connection hole which connects the internal space and an external space; and an opening/closing member that is attached to the detachable body main body, the opening/closing member being movable between an opening position where the connection hole is exposed and a closing position where the connection hole is closed. The opening/closing member includes: an opening/closing member main body that is curved parallel with a movement direction of the opening/closing member between the opening position and the closing position; and a plane portion that has a flat surface, the plane potion being formed in an outer surface of the opening/closing member main body.

BRIEF DESCRIPTION OF THE DRAWINGS

Exemplary embodiment(s) of the present invention will be described in detail based on the following figures, wherein:

FIG. 18A is a perspective view of the shutter as viewed from the outside; FIG. 18B is a perspective view of the shutter as viewed from the inside.

FIG. 21A shows a relationship between a sorting block and a shutter TC2, FIG. 21B shows shutters being conveyed by a linear conveying unit, and FIG. 21C shows relationships between a shutter being conveyed and a conveyance surface and guide walls;

FIG. 24A is an enlarged view of an important part of FIG. 19, FIG. 24B is a side view as viewed from the direction XXIVB in FIG. 24A, and FIG. 24C is a view as viewed from the direction XXIVC in FIG. 23B;

FIG. 26A corresponds to FIG. 5 (first embodiment) and FIG. 26B shows a housing recess of a shutter housing portion.

DETAILED DESCRIPTION

Figure 1:
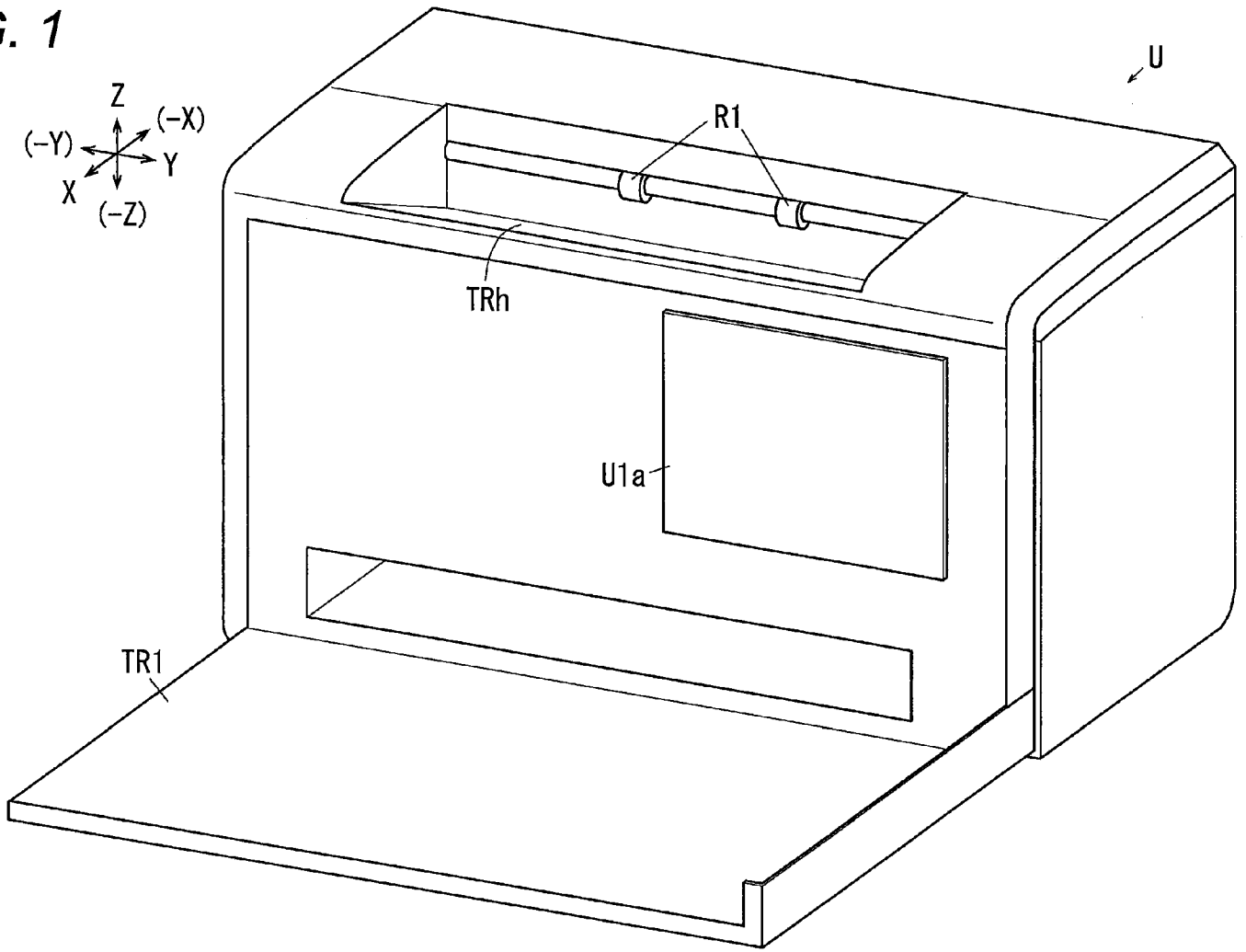
FIG. 1 is a perspective view of an image forming apparatus according to a first embodiment.

Although embodiments of the present invention will be described below with reference to the drawings, the invention is not limited to those embodiments.

To facilitate understanding of the following description, in the drawings, the X-axis direction, the Y-axis direction, and the Z-axis direction are defined as the front-rear direction, the right-left direction, and the top-bottom direction, respectively, and the directions or sides indicated by arrows X, −X, Y, −Y, and Z, and −Z are defined as the front direction or side, the rear direction or side, the right direction or side, the left direction or side, the top direction or side, and the bottom direction or side, respectively.

In the drawings, a circle "o" having a dot "•" inside means an arrow that is directed from the back side to the front side of the paper surface and a circle "o" having a cross "x" inside means an arrow that is directed from the front side to the back side of the paper surface.

Furthermore, in the drawings, to facilitate understanding, members etc. that are not indispensable for a description may be omitted as appropriate.

[Embodiment 1]

FIG. 1 is a perspective view of an image forming apparatus according to a first embodiment.

As shown in FIG. 1, a sheet supply tray TR1 (example sheet supply unit) which houses recording sheets S (example media) occupies a bottom-front space of the image forming apparatus according to the embodiment which is a printer U. An ejected sheet tray TRh (example ejected sheet receiving unit) to which sheets S on which images are recorded are ejected constitutes part of the top wall of the printer U. A front cover U1*a* (example opening/closing member) which is opened in manipulating a toner cartridge TC (example detachable body; described later) containing developer inside is formed at a front-right position.

Figure 2:
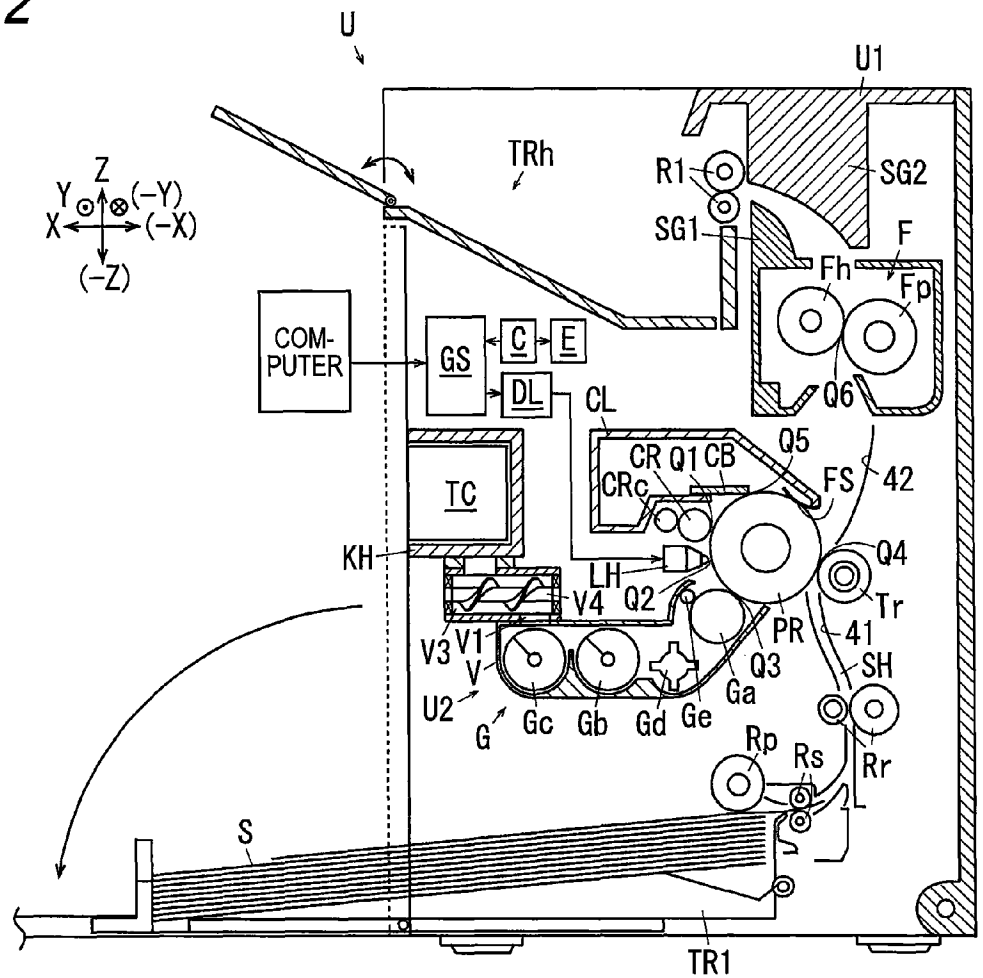
FIG. 2 shows the configuration of the entire image forming apparatus according to the first embodiment.

FIG. 2 shows the configuration of the entire image forming apparatus according to the first embodiment.

As shown in FIG. 2, the printer U has a printer main body U1 (example image forming apparatus main body). The printer main body U1 is equipped with a controller C (example control section), an image processing section GS whose operation is controlled by the controller C, a laser drive circuit DL (example latent image forming circuit), a power device E, etc. The power device E applies voltages to a charging roll CR (example charger; described later), a developing roll Ga (example developer holding body), a transfer roll Tr (example transfer member), etc.

The image processing section GS converts print information that is input from an external computer (example information transmitting apparatus) or the like into image information for latent image formation and outputs the generated image information to the laser drive circuit DL with preset timing. The laser drive circuit DL a drive signal to a latent image forming device LH on the basis of the received image information. In the first embodiment, the latent image forming device LH is a device (LED head) in which LEDs (example latent image writing elements) are arranged in line in the right-left direction at preset intervals.

A photoreceptor body PR (example image holding body) which is rotationally driven is supported so as to be disposed at a rear position in the printer main body U1. The charging roll CR, the latent image forming device LH, a developing device G, the transfer roll Tr, and a photoreceptor body cleaner CL (example image forming body cleaner) are arranged around the photoreceptor body PR in the rotation direction of the photoreceptor body PR.

As shown in FIG. 2, a charging roll cleaner CRc (example charger cleaner) for cleaning the surface of the charging roll CR is opposed to the charging roll CR so as to be in contact with it.

The developing device G has a developer container V which contains developer inside. The developing roll Ga which is opposed to the photoreceptor body PR, a pair of circulatory transport members Gb and Gc for transporting (circulating) developer while agitating it, a supply member Gd for transporting the developer agitated by the circulatory transport members Gb and Gc to the developing roll Ga, and a layer thickness limiting member Ge for limiting the layer thickness of developer existing on the surface of the developing roll Ga are provided inside the developer container V.

A developer supply hole V1 (example supply portion) is formed through the top wall of the developer container V at a front position. A developer supply passage V3 (example developer transport passage) which extends forward is connected to the developer supply hole V1. A supply auger V4 (example developer transport member) is supported rotatably so as to be disposed inside the developer supply passage V3. A cartridge holder KH (example attachment/detachment subject member) to which the toner cartridge TC is attached in a detachable manner is connected to a front end portion of the developer supply passage V3. Toner flows into the developer supply passage V3 from the toner cartridge TC via the cartridge holder KH. Therefore, toner is supplied from the toner cartridge TC to the developing device G by driving the supply auger V4 according to a toner consumption in the developing device G.

The surface of the photoreceptor body PR which is rotating is charged by the charging roll CR at a charging region Q1, and a latent image is formed on the surface of the photoreceptor body PR at a latent image forming position Q2 by latent image forming light that is emitted from the latent image forming device LH. The latent image is developed by the developing roll Ga at a developing region Q3 into a toner image (example visible image), which is transferred a recording sheet S (example medium) by the transfer roll Tr at a transfer region Q4 where the photoreceptor body PR and the transfer roll Tr are opposed to each other. Residual toner on the surface of the photoreceptor body PR is removed by a cleaning blade CB (example cleaning member) at a cleaning region Q5 which is downstream of the transfer region Q4, and is collected into a photoreceptor cleaner CL.

A film seal FS (example scattering preventive member), which is disposed on the side opposite to the cleaning blade CB, prevents toner that has been collected into the photoreceptor cleaner CL from dropping down.

As shown in FIG. 2, the sheet supply tray TR1 which occupies a bottom space of the printer main body U1 is provided with a pickup roll Rp (example medium pickup member). Sheets S that are picked up by the pickup roll Rp are separated into individual sheets S by separating rolls (example media separating members) which are a retard roll and a sheet supply roll. A separated sheet S is conveyed along a sheet conveyance path SH and then conveyed to the transfer region Q4 with preset timing by registration rolls Rr (example timing adjusting members) which are disposed upstream of the transfer region Q4 in the sheet conveying direction.

The transport roll Tr to which a transfer voltage is applied by the power device E whose operation is controlled by the controller C transfers a toner image from the photoreceptor body PR to the recording sheet S which is passing the transfer region Q4.

The recording sheet S to which the toner image has been transferred at the transfer region Q4 but not fused yet is conveyed to a fusing device F. The fusing device F has a pair of fusing rolls Fh and Fp (example fusing members), and a fusing region Q6 is formed as a pressure contact region of the pair of fusing rolls Fh and Fp. In the fusing device F, the toner image formed on the recording sheet S is fused by the pair of fusing rolls Fh and Fp at the fusing region Q6. The recording sheet S bearing the fused toner image is conveyed being guided by sheet guides SG1 and SG2 (example medium guide members), and ejected to the ejected sheet tray TRh by ejection rolls R1 (example ejection members).

(Cartridge Holder KH)

Figure 3:
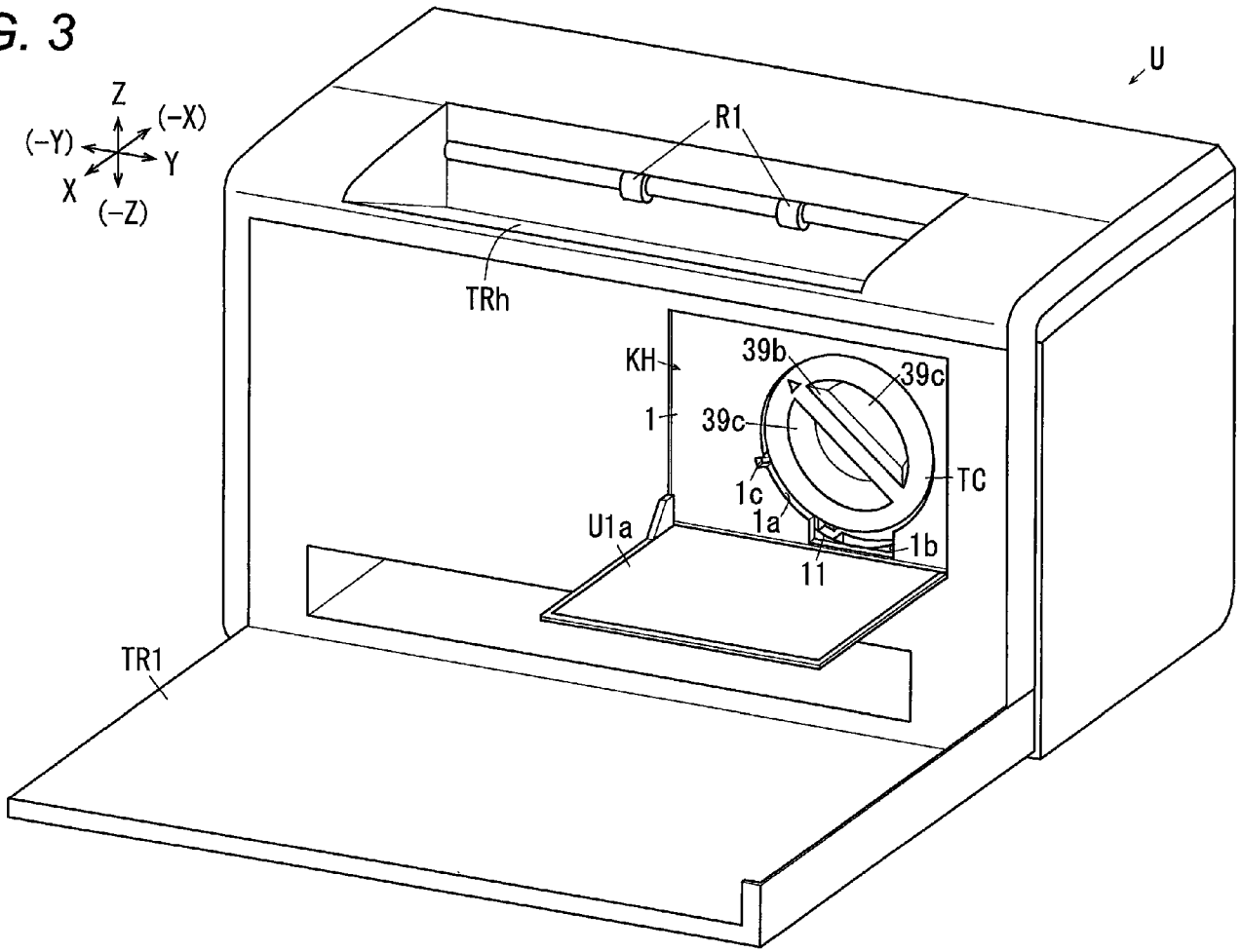
FIG. 3 shows the image forming apparatus according to the first embodiment in a state that a front cover is opened.
Figure 4:
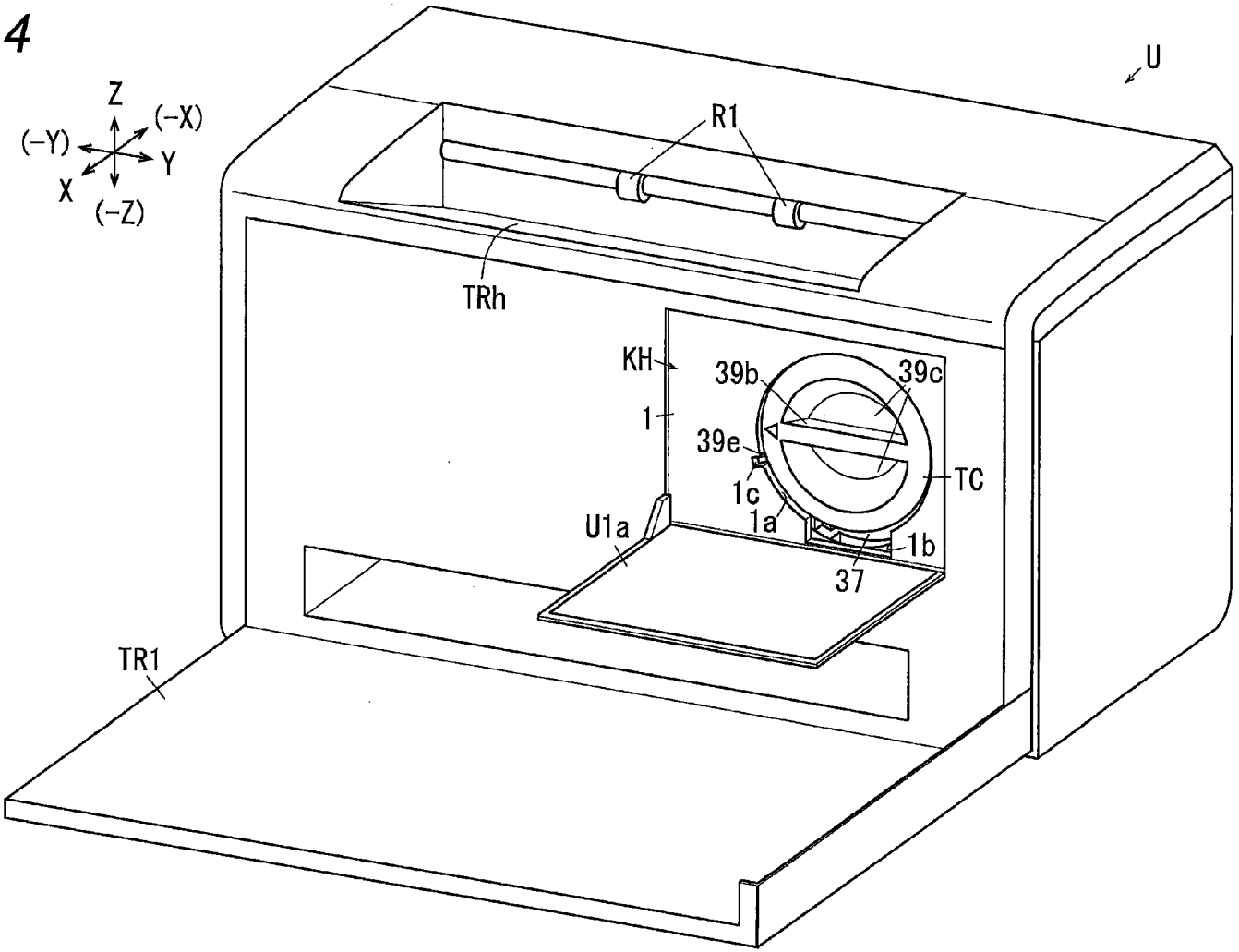
FIG. 4 shows a state that a toner cartridge has been rotated from a non-detachable position of FIG. 3 to a detachable position.

FIG. 3 shows the image forming apparatus according to the first embodiment in a state that the front cover U1*a* is opened. FIG. 4 shows a state that the toner cartridge TC has been rotated from a non-detachable position of FIG. 3 to a detachable position.

As seen from FIGS. 1, 3, and 4, the toner cartridge TC and the cartridge holder KH to which the toner cartridge TC is attached are exposed to the outside by moving the front cover U1*a* of the printer U according to the first embodiment from the ordinary position of FIG. 1 to the manipulation position of FIGS. 3 and 4.

Figure 5:
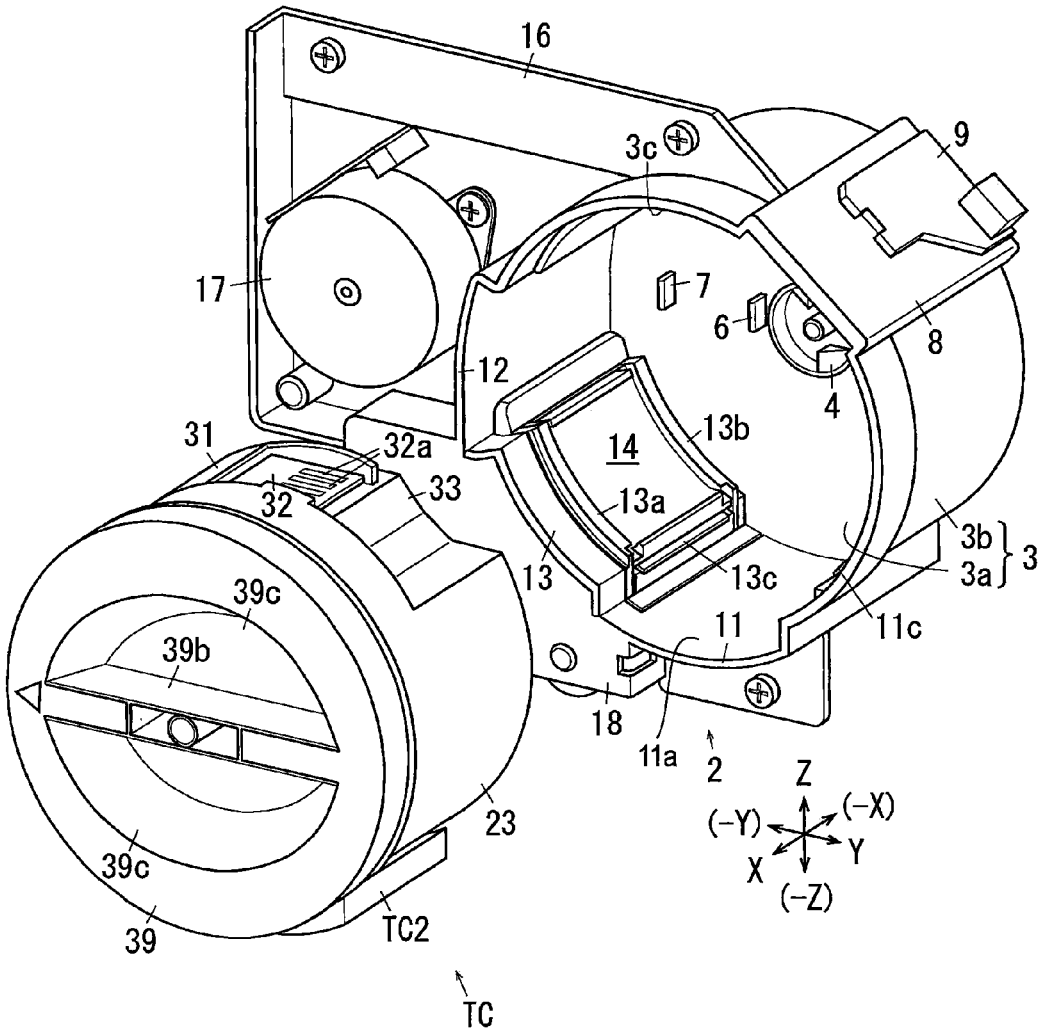
FIG. 5 shows an important part of the image forming apparatus in a state that the toner cartridge is detached from a cartridge holder.
Figure 6:
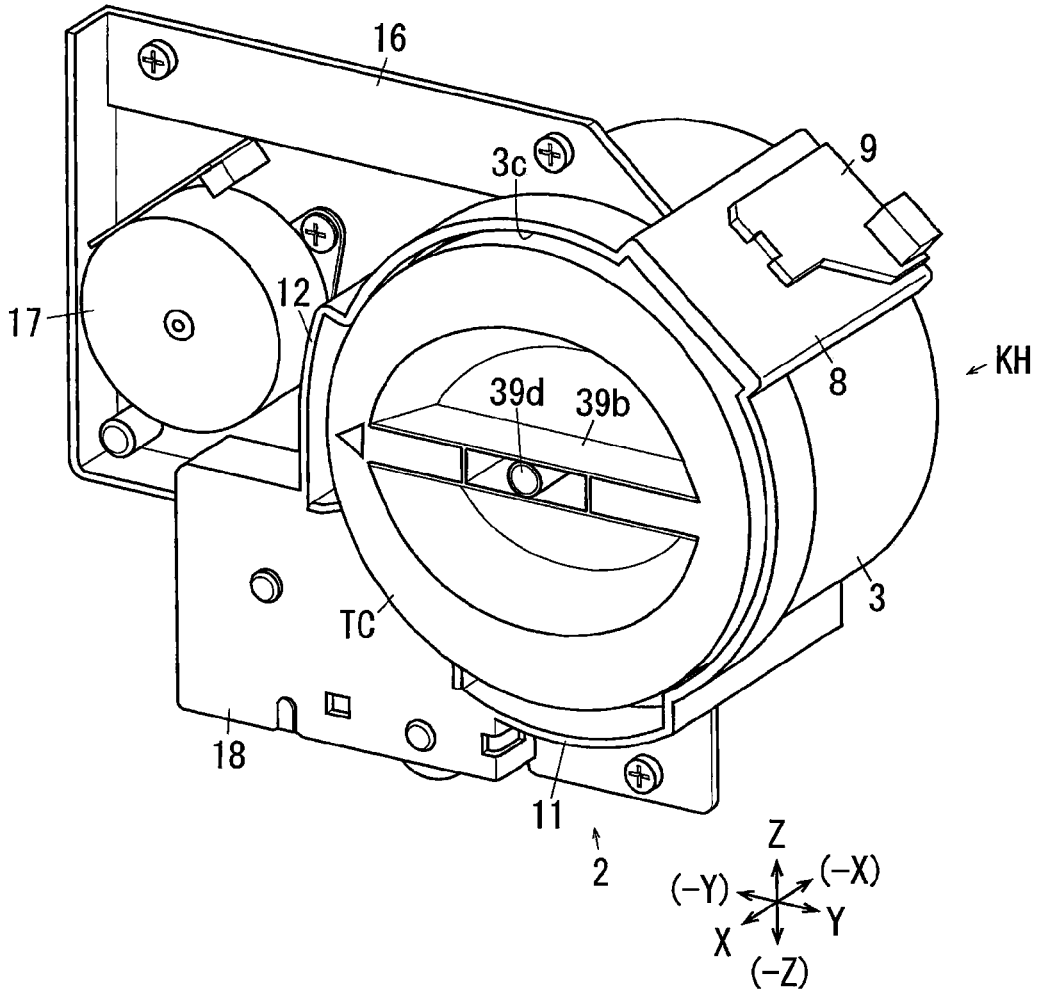
FIG. 6 shows an important part of the image forming apparatus in a state that the toner cartridge is attached to the cartridge holder.
Figure 7:
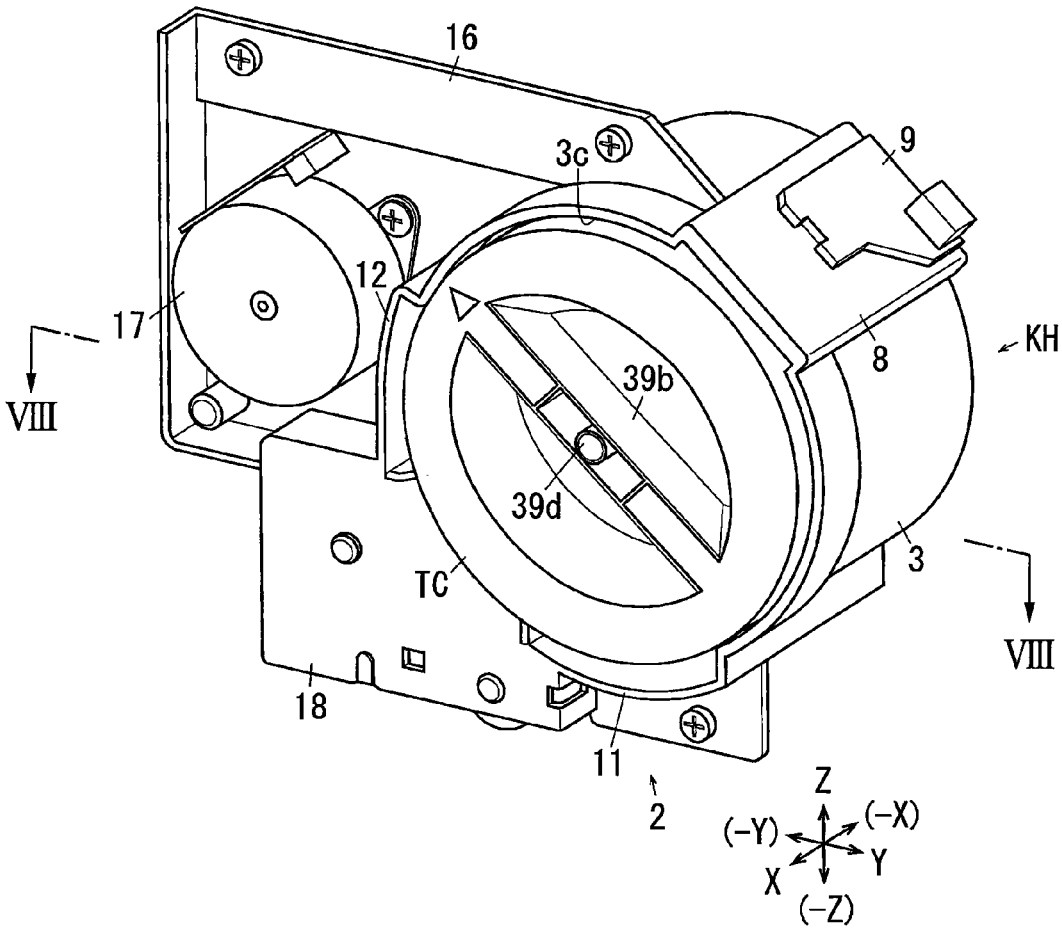
FIG. 7 shows an important part of the image forming apparatus in a state that the toner cartridge is attached to the cartridge holder and rotated to the non-detachable position.
Figure 8:
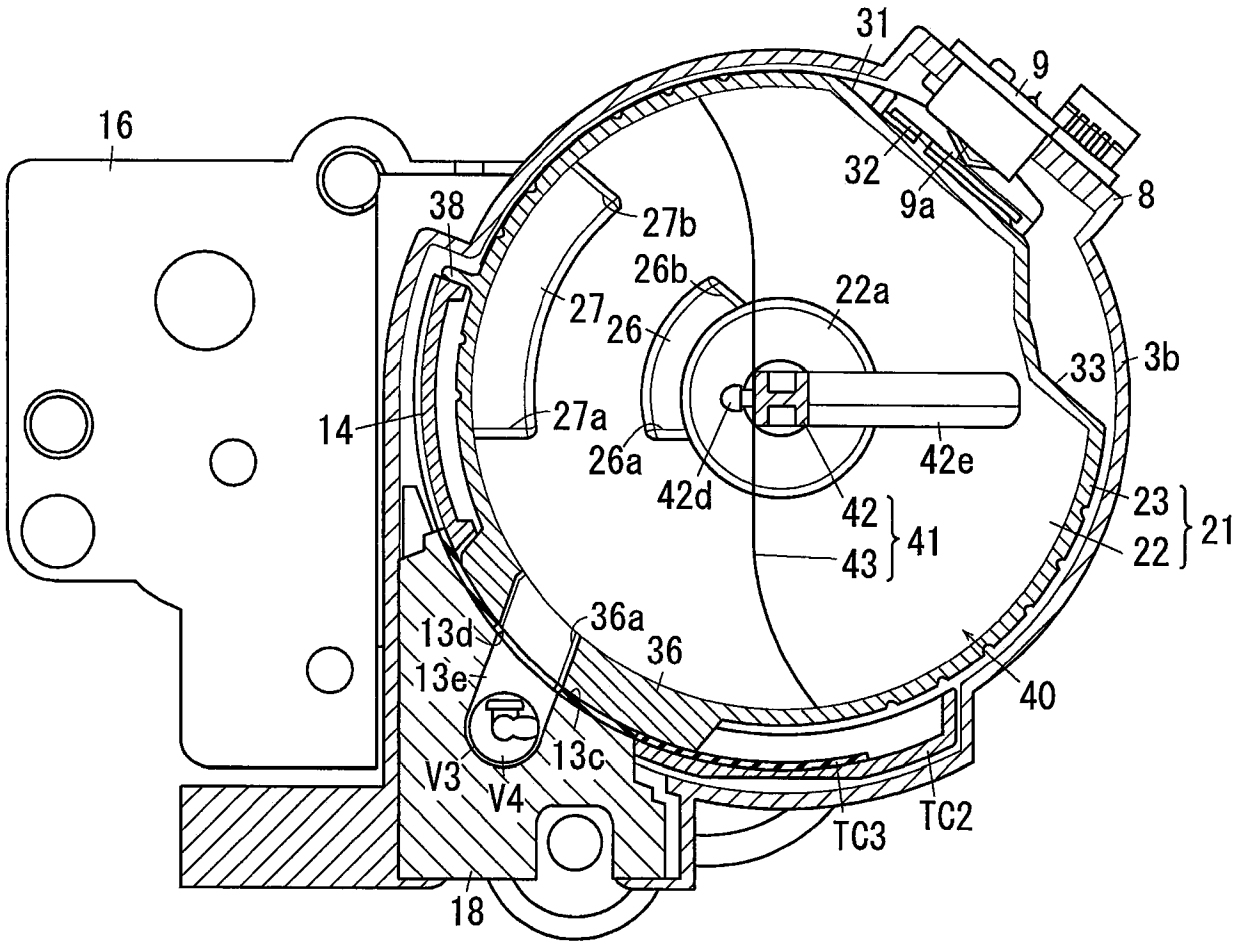
FIG. 8 is a sectional view at the line VIII-VIII in FIG. 7.

FIG. 5 shows an important part of the image forming apparatus in a state that the toner cartridge TC is detached from the cartridge holder KH. FIG. 6 shows an important part of the image forming apparatus in a state that the toner cartridge TC is attached to the cartridge holder KH. FIG. 7 shows an important part of the image forming apparatus in a state that the toner cartridge TC is attached to the cartridge holder KH and rotated to the non-detachable position. FIG. 8 is a sectional view at the line VIII-VIII in FIG. 7.

As shown in FIGS. 3 and 4, the cartridge holder KH which is supported by the printer main body U1 (example image forming apparatus main body, example attachment/detachment apparatus) has a front panel 1 (example front member). The front panel 1 is formed with a circular opening 1*a* through which the toner cartridge TC is attached and detached. A shutter passing portion 1*b* (example opening/closing member passing portion) is formed as a bottom cut of the opening 1*a*, and a projected strip passing portion 1*c* is formed as a left-hand small cut of the opening 1*a*.

As shown in FIGS. 5-8, a holder main body 2 (example attachment/detachment member main body) is supported so as to be disposed inside the front panel 1. The holder main body 2 has a cartridge housing portion 3 (example detachable body housing portion) which is a cylindrical hole whose axis extends in the front-rear direction which is the cartridge attaching/detaching direction.

As shown in FIG. 5, the cartridge housing portion 3 has a disc-shaped rear end wall 3*a* and a cylindrical wall 3*b* which extends forward from the rear end wall 3*a*. A drive coupling 4 (example drive power transmitting member) is supported so as to be disposed at the center of the rear end wall 3*a*. A pair of (right and left) positioning projections 6 and 7 (example projections) which project forward (i.e., toward the origin side of the cartridge inserting direction) are formed on the left of the drive coupling 4.

As shown in FIGS. 5-8, a reader support portion 8 is formed as a top-right recess, recessed to the top right with respect to an inner circumferential surface 3*c*, of the cylindrical wall 3*b*. A CRUM reader 9 (example reading/writing device) capable of information reading and writing through information exchange is supported by the reader support portion 8. As shown in FIG. 8, the CRUM reader 9 has a connector 9*a* (example contact terminal) which is a leaf spring projecting to inside the cylindrical wall 3*b*.

As shown in FIGS. 5-8, a shutter housing portion 11 (example opening/closing member housing portion) is formed as a bottom recess, recessed downward (i.e., outward in the radial direction) respect to the inner circumferential surface 3*c*, of the cylindrical wall 3*b*. A release portion 11*c* is formed at a right-hand rear end position in the shutter housing portion 11 so as to be inclined more upward as the position goes rearward. An arc-shaped projected strip housing recess 12 (example projected strip housing portion) is formed as a left recess, recessed leftward (i.e., outward in the radial direction) respect to the inner circumferential surface 3*c*, of the cylindrical wall 3*b*.

As shown in FIGS. 5 and 8, an inlet portion 13 is formed between the shutter housing portion 11 and the strip housing recess 12 of the cylindrical wall 3*b* so as to extend in the circumferential direction of the cylindrical wall 3*b*. As shown in FIG. 5, the inlet portion 13 is formed with a pair of (front and rear) shutter guides 13*a* and 13*b* (example guide members). An inlet shutter 14 (example inlet opening/closing member) is disposed between the shutter guides 13*a* and 13*b* and supported so as to be movable in the circumferential direction of the cylindrical wall 3*b*.

As shown in FIGS. 5 and 8, the inlet portion 13 has a step-like inflow surface 13*c* which is formed between the shutter guides 13*a* and 13*b* so as to be one-step lower than the inner circumferential surface 3*c* of the cylindrical wall 3*b* and one-step higher than a bottom surface 11 a of the shutter housing portion 11.

As shown in FIG. 8, the inflow surface 13*c* is formed with an inlet 13*d* which is located under the inlet shutter 14 and an inflow passage 13*e* which extends downward from the inlet 13*d*. The lower end of the inlet 13*d* is connected to the upstream end of the developer supply passage V3.

As shown in FIGS. 5-8, a motor support plate 16 (example drive source support member) is supported by the cartridge housing portion 3 so as to extend leftward. A cartridge motor 17 (example drive source) is supported by the motor support plate 16.

A gear support portion 18 (example transmission system support portion) is formed under the motor support plate 16. A gear train of plural gears (not shown) for transmitting drive power from the cartridge motor 17 to the drive coupling 4, the supply auger 4, etc. are supported by the gear support portion 18.

(Toner Cartridge TC)

Figure 9:
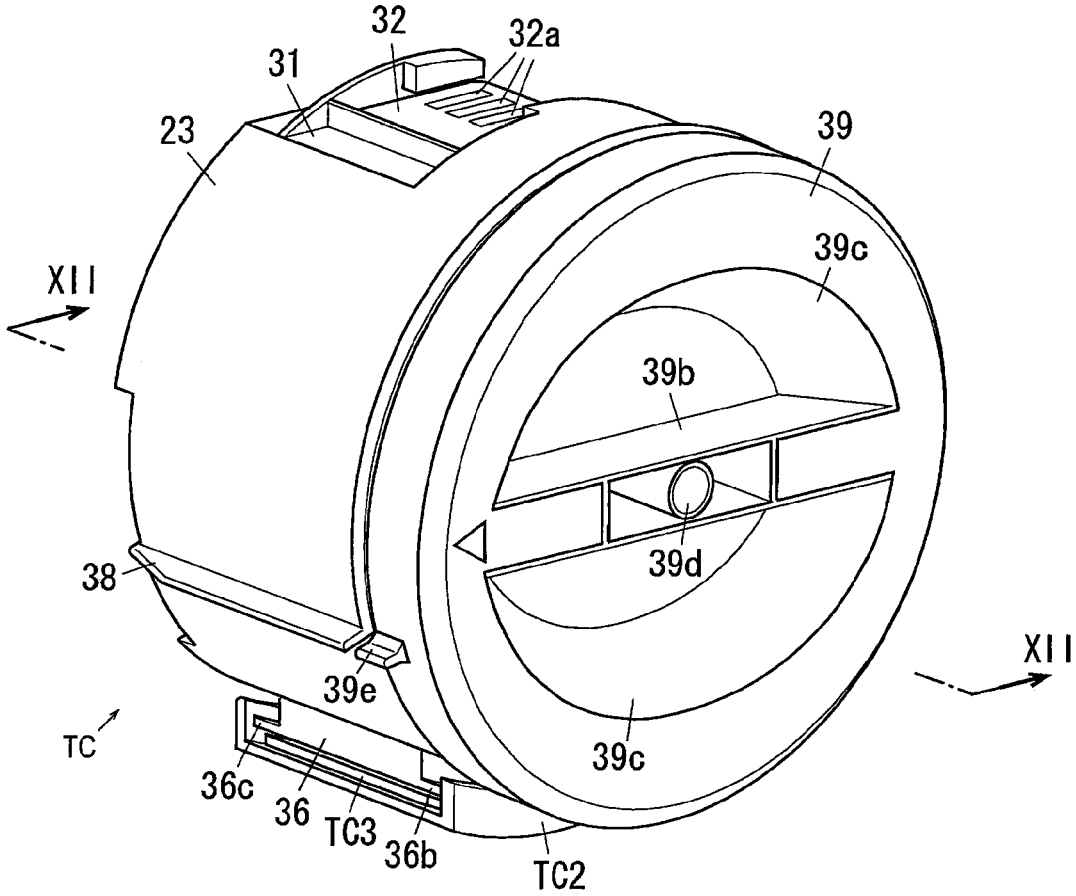
FIG. 9 is a perspective view of the toner cartridge as viewed obliquely from the front side.
Figure 10:
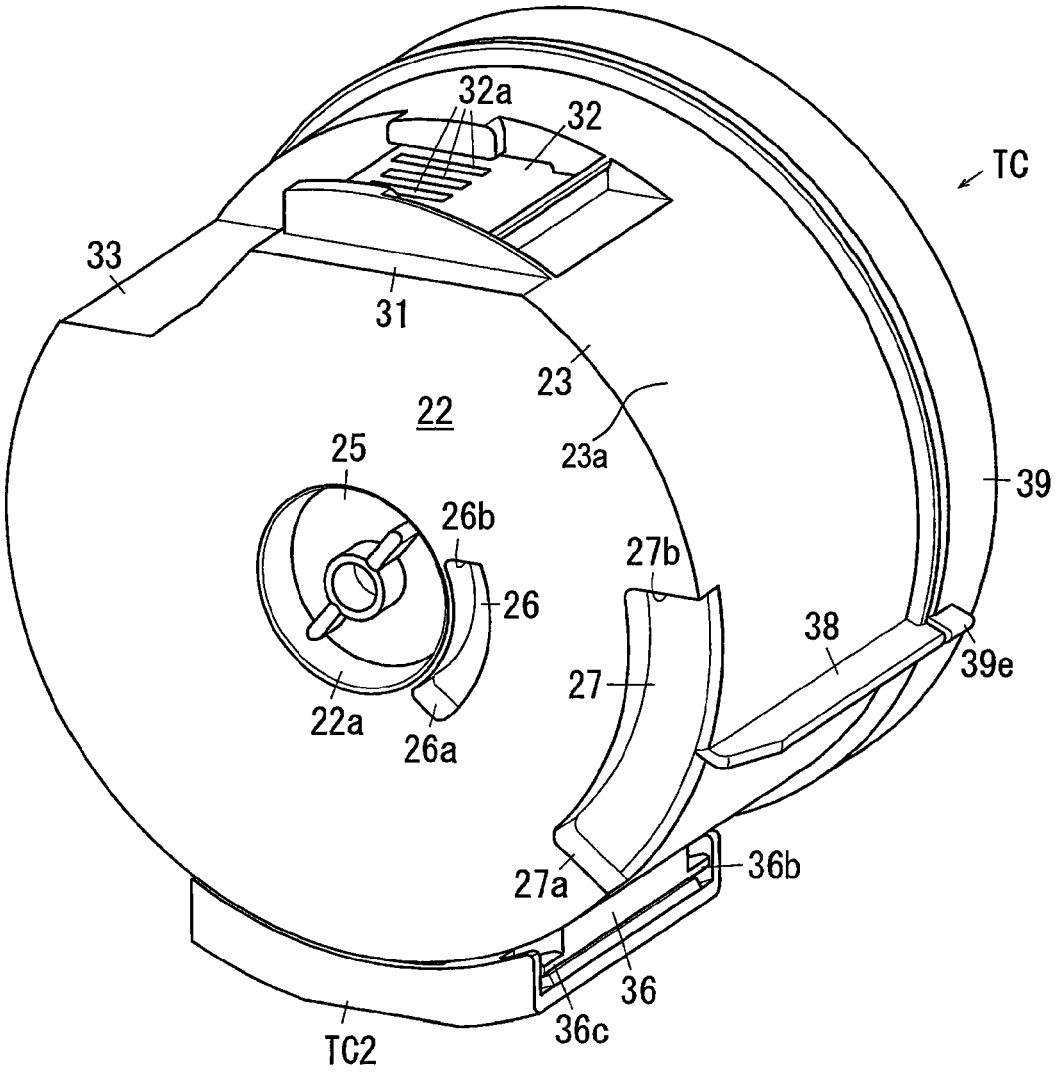
FIG. 10 is a perspective view of the toner cartridge as viewed obliquely from the rear side.
Figure 11:
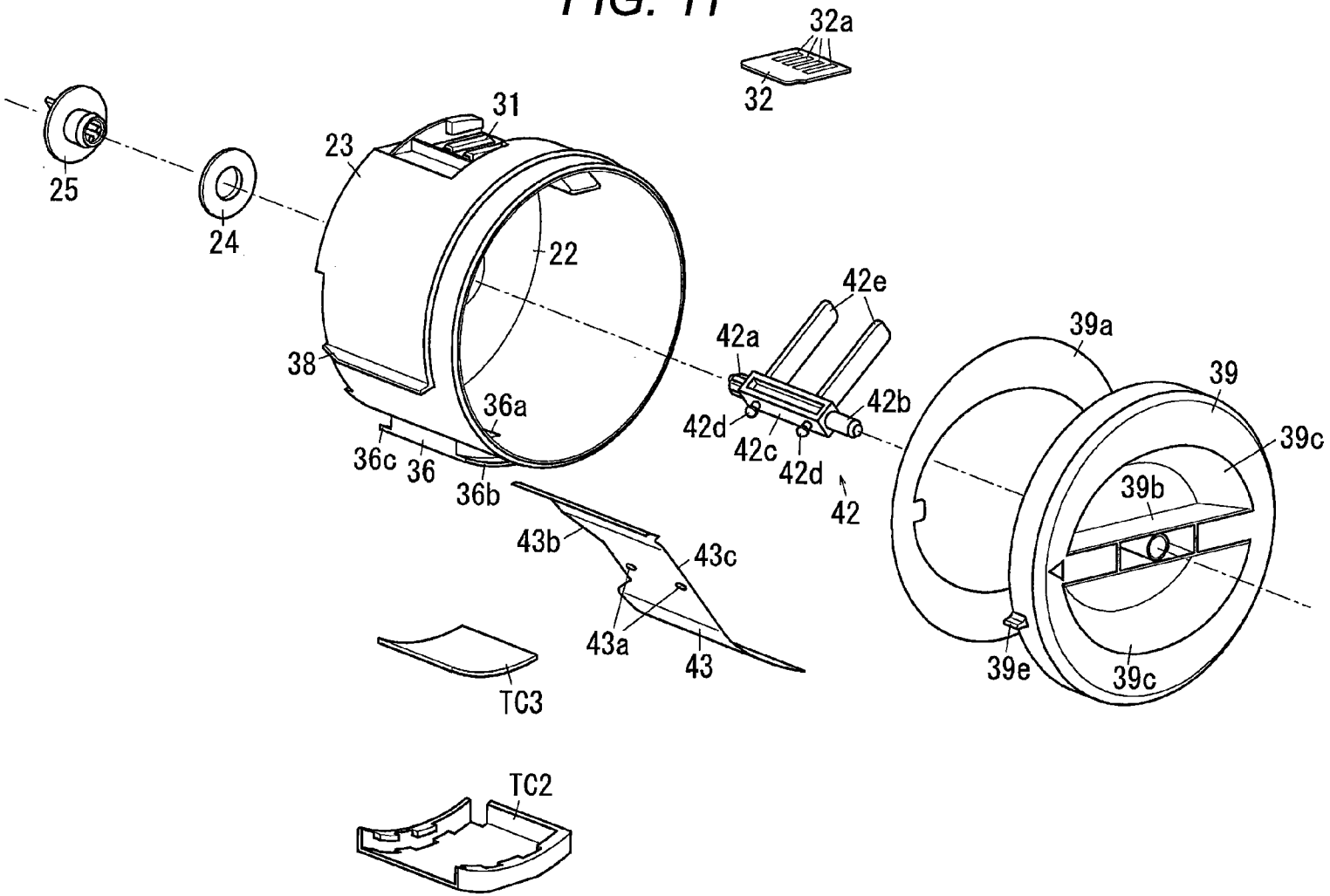
FIG. 11 is an exploded view of the toner cartridge.
Figure 12:
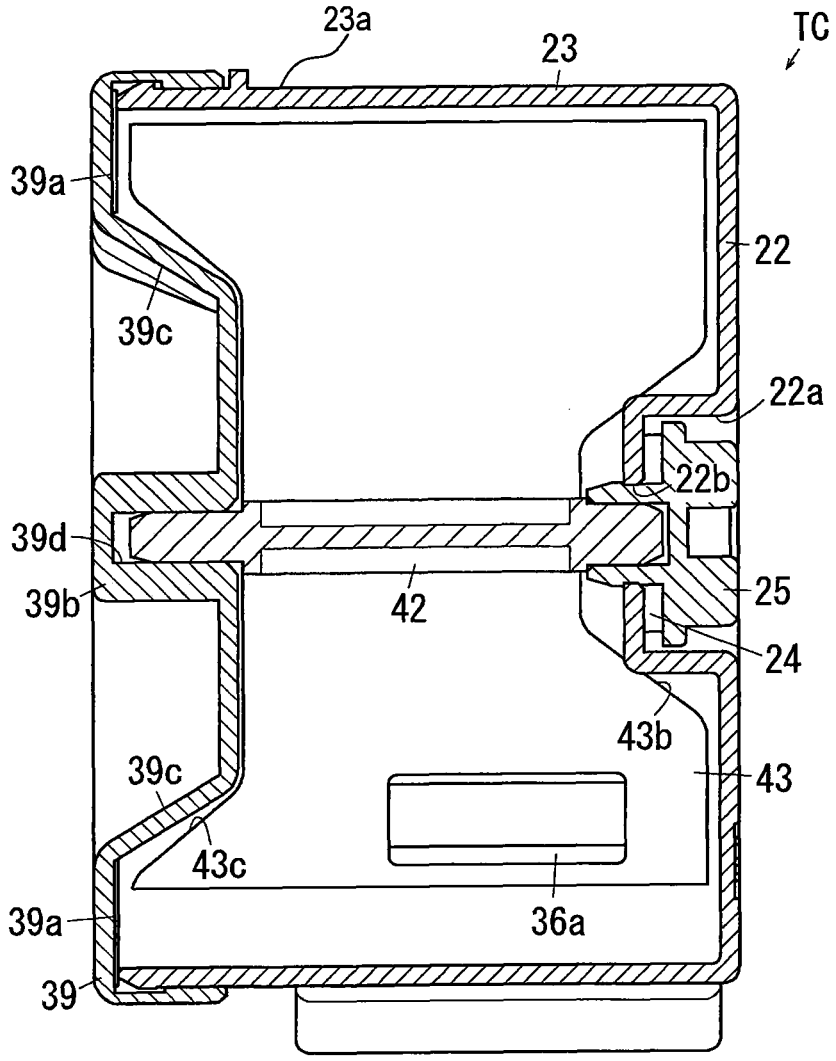
FIG. 12 is a sectional view at the line XII-XII in FIG. 9.
Figure 13:
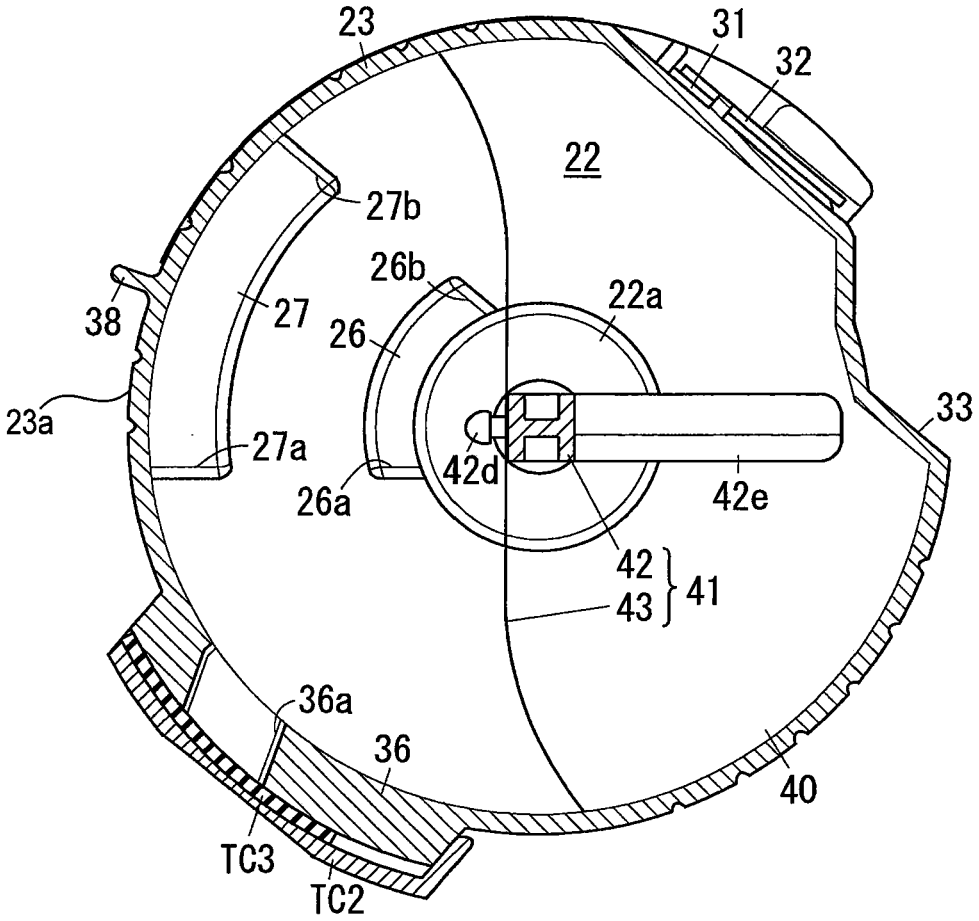
FIG. 13 is a sectional view of the toner cartridge TC part of FIG. 8.
Figure 14:
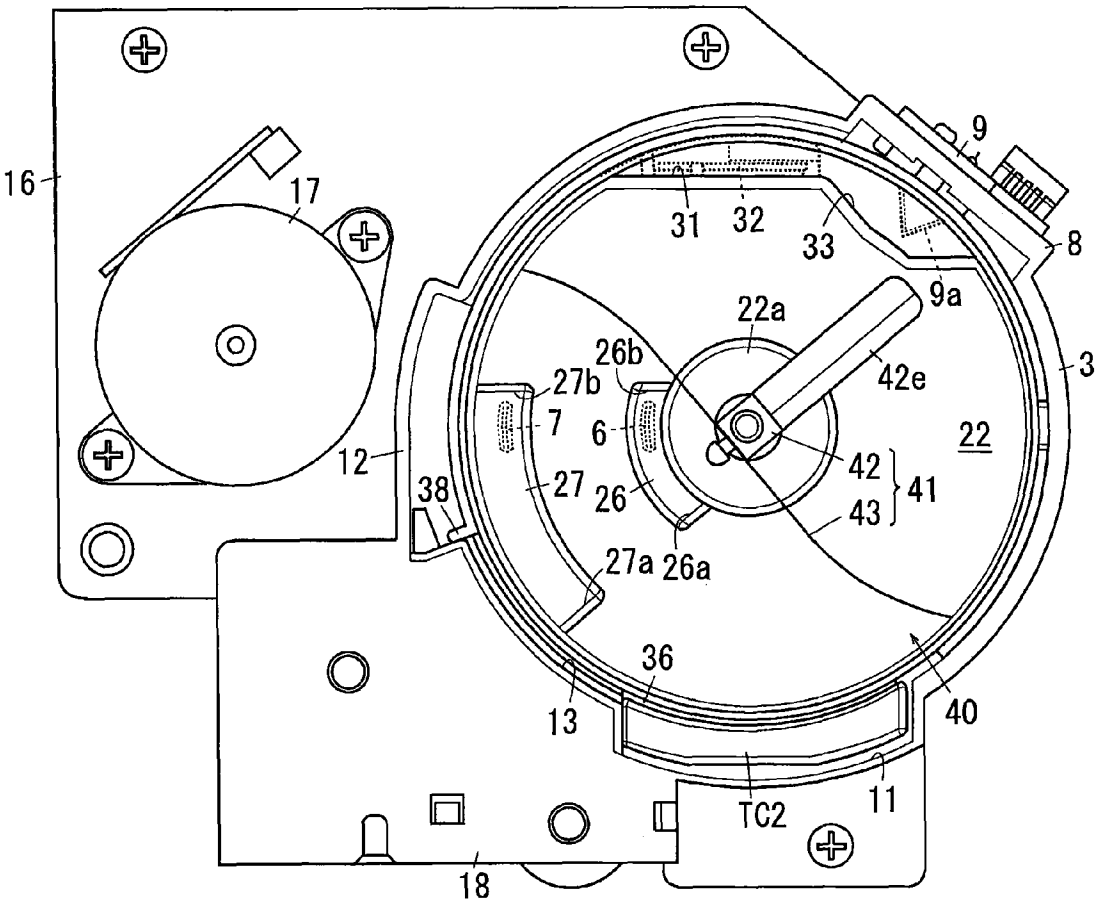
FIG. 14 shows an important part of the image forming apparatus in a state that the toner cartridge has been moved to the detachable position.
Figure 15:
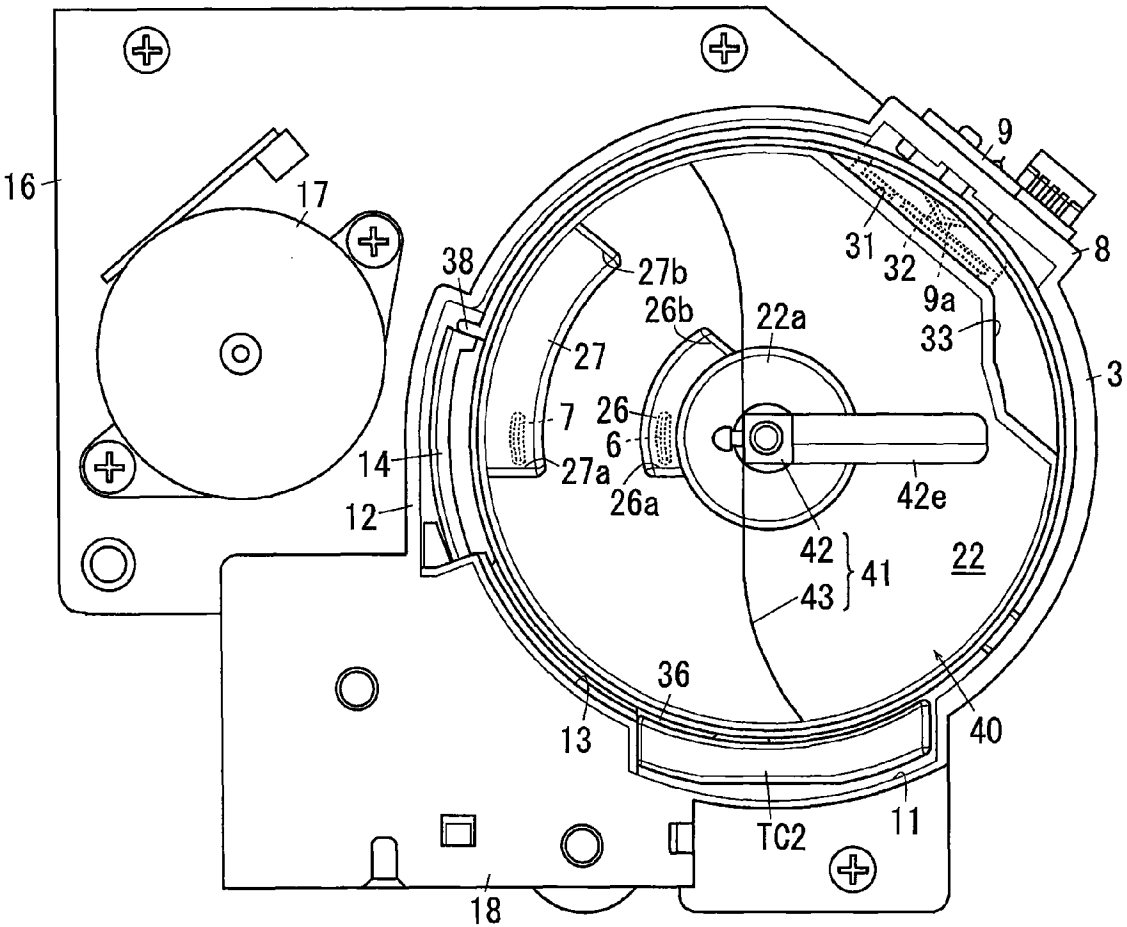
FIG. 15 shows an important part of the image forming apparatus in a state that the toner cartridge has been moved to the non-detachable position.

FIG. 9 is a perspective view of the toner cartridge TC as viewed obliquely from the front side. FIG. 10 is a perspective view of the toner cartridge TC as viewed obliquely from the rear side. FIG. 11 is an exploded view of the toner cartridge TC. FIG. 12 is a sectional view at the line XII-XII in FIG. 9. FIG. 13 is a sectional view of the toner cartridge TC part of FIG. 8. FIG. 14 shows an important part of the image forming apparatus in a state that the toner cartridge TC has been moved to the detachable position. FIG. 15 shows an important part of the image forming apparatus in a state that the toner cartridge TC has been moved to the non-detachable position. FIGS. 14 and 15 are front views in a state that a cartridge cover is removed.

As shown in FIGS. 5-15, the toner cartridge TC which is attached to or detached from the cartridge holder KH has a cylindrical cartridge main body TC1 (example detachable body main body) whose rotation axis extends in the front-rear direction which is the insertion direction (attaching/detaching direction). The cartridge main body TC1 has a cylinder portion 22+23 consisting of a disc-shaped rear end wall 22 (example bottom wall) which is located at the destination end in the insertion direction (i.e., the rear end in the front-rear direction) and a cylindrical wall 23 which extends forward from the rear end wall 22. As shown in FIGS. 10 and 12, the rear end wall 22 is formed, at the center, with a cylindrical transmission housing portion 22*a* which is recessed forward. An opening 22*b* penetrates through the transmission housing portion 22*a* in the front-rear direction. As shown in FIG. 11, a follower coupling 25 (example transmission subject member) to engage with the drive coupling 4 is supported rotatably by the transmission housing portion 22*a* via a coupling seal (example leakage preventive member).

As shown in FIGS. 8, 10, and 12-15, the rear end wall 22 is formed with positioning grooves 26 and 27 (example rotation stop portions) which are recessed forward (i.e., toward the origin side of the insertion direction) in such a manner that they correspond to the above-mentioned positioning projections 6 and 7, respectively. In the first embodiment, the positioning grooves 26 and 27 are formed like concentric arcs having the opening 22*b* (formed at the center of the rear end wall 22) as the center and can be fitted with the respective positioning projections 6 and 7. As shown in FIG. 10, the arc-shaped positioning grooves 26 and 27 have respective lower end surfaces 26*a* and 27*a* which extend in the radial direction and respective upper end surfaces 26*b* and 27*b* which also extend in the radial direction.

In the first embodiment, the arc-shaped positioning grooves 26 and 27 have the same central angle which corresponds to an angle of rotation of the toner cartridge TC between an unlock position which is an example of the detachable position shown in FIGS. 4 and 14 and a positioning position which is an example of the non-detachable position shown in FIGS. 3 and 15.

As shown in FIGS. 14 and 15, when the toner cartridge TC is attached to the cartridge holder KH, the positioning projections 6 and 7 are fitted into and held by the respective positioning grooves 26 and 27. At this time, if the toner cartridge TC is oriented at the unlock position shown in FIG. 14, the positioning projections 6 and 7 are held in a state that they are in contact with or are slightly spaced from the upper end surfaces 26*b* and 27*b* of the positioning grooves 26 and 27, respectively. If the toner cartridge TC is oriented at the positioning position shown in FIG. 15, the positioning projections 6 and 7 are held in a state that they are in contact with the lower end surfaces 26*a* and 27*a* of the positioning grooves 26 and 27, respectively.

That is, if the toner cartridge TC is oriented at the unlock position shown in FIG. 14, the upper end surfaces 26*b* and 27*b* are arranged approximately in the horizontal direction (9 o'clock direction). If the toner cartridge TC is oriented at the positioning position shown in FIG. 15, the lower end surfaces 26*a* and 27*a* are arranged approximately in the horizontal direction. Therefore, when the toner cartridge TC is oriented at the positioning position shown in FIG. 15, the upper end surfaces 26*b* and 27*b* are arranged in a direction that goes down (in the direction of gravity) as the position goes closer to the rotation center.

The structures of the positioning grooves 26 and 27 are not limited to the above ones. For example, the central angle of the positioning grooves 26 and 27 may be increased by a preset angle from the unlock position to a side opposite to the positioning position. The positioning grooves 26 and 27 may have different central angles rather than the same central angle. Other examples of the non-detachable position are a position where the toner cartridge TC is rotated from the detachable position by a preset angle and the upper end surfaces 26*b* and 27*b* are spaced from the respective positioning projections 6 and 7 and a position where the toner cartridge TC is rotated from the detachable position by a preset angle to the side opposite to the positioning position of the first embodiment. The positions of the positioning projections 6 and 7 can be set according to these structures.

As shown in FIGS. 5, 8-11, and 13-15, the cylindrical wall 23 is formed, at the top, with a CRUM holding portion 31 (example storage member holding portion) which is recessed inward with respect to an outer circumferential surface 23*a* of the cylindrical wall 23. A CRUM (customer replaceable unit memory; example information storage member) 32 which is a plate-like circuit board is mounted on the CRUM holding portion 31. Pieces of information relating to the toner cartridge TC such as apparatus types that are compatible with the toner cartridge TC, an initial charge amount of contained developer, an amount of residual developer which decreases as the developer is consumed, and whether (almost) no developer remains.

As shown in FIGS. 9 and 10, the CRUM 32 has a connector portion 32*a* (example contact terminal) to be brought into contact with the connector 9*a* of the CRM reader 9. When the toner cartridge TC is oriented at the positioning position shown in FIG. 15, the connector portion 32*a* is in contact with the connector 9*a*, whereby information can be written to and read from the CRUM 32. As for the contact between the connector portion 32*a* of the CRUM 32 and the connector 9*a* of the CRUM reader 9, more specifically, the connector portion 32*a* of the CRUM 32 comes into contact with the connector 9*a* of the CRUM reader 9 at a position where the toner cartridge TC has been rotated by a preset angle from the unlock position toward the positioning position and has not reached the positioning position yet. Then, the toner cartridge TC is rotated further toward the positioning position, the lower end surfaces 26*a* and 27*a* of the positioning grooves 26 and 27 of the toner cartridge TC comes into contact with the respective positioning projections 6 and 7 and the toner cartridge TC is positioned in the rotation direction.

The CRUM holding portion 31 of the cylinder wall 23 is formed, at a right position, a connector relief 33 (example interference preventive portion) which is recessed inward with respect to the outer circumferential surface 23*a*. The connector relief 33 is formed so that the connector 9*a* enters it for escape and is thereby prevented from contacting the connector 9*a* of the CRUM reader 9 and, for example, being damaged when the toner cartridge TC is inserted into the cartridge housing portion 3.

Figure 16:
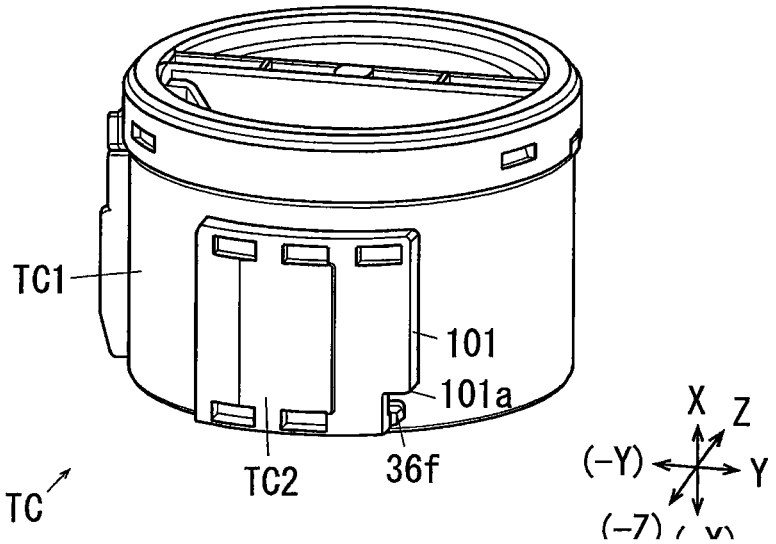
FIG. 16 is a perspective view of the toner cartridge as viewed from the shutter side.

FIG. 16 is a perspective view of the toner cartridge TC as viewed from the shutter TC2 side.

Figure 17:
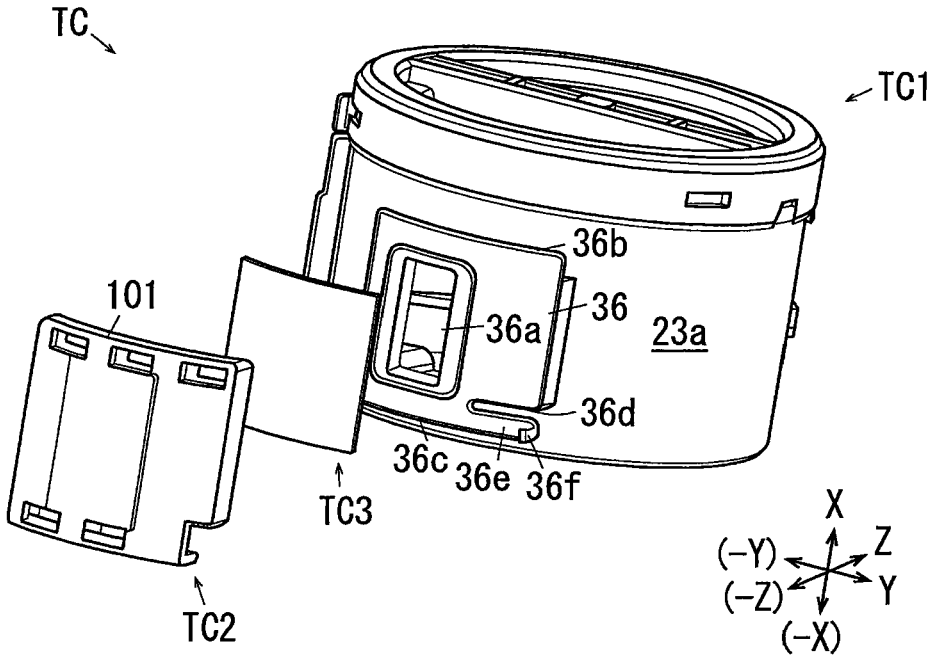
FIG. 17 is a perspective view showing relationships between the toner cartridge main body, a cartridge seal, and a shutter.

FIG. 17 is a perspective view showing relationships between the toner cartridge main body TC1, a cartridge seal, and a shutter TC2.

As shown in FIGS. 8-11, 16, and 17, the cylindrical wall 23 is formed, at a position that is near the bottom and corresponds to the shutter housing portion 11, with an outlet portion 36 which projects downward (i.e., outward in the radial direction) from the outer circumferential surface 23*a* of the cylindrical wall 23. As shown in FIGS. 8 and 13, an outlet 36*a* (example connection hole) which connects the inside and the outside of the cylindrical wall 23 is formed through the outlet portion 36. The outlet 36*a* is formed at a position that is deviated clockwise from the center of the outlet portion 36 when viewed in FIG. 13, and is connected to the inlet 13*d* when the toner cartridge TC is oriented at the positioning position shown in FIGS. 8 and 15. In the first embodiment, when viewed in FIG. 13, the outlet 36*a* extends in a direction that is closer to the vertical direction than the radial direction is, which lowers the probability that developer is stuck in the outlet 36*a* in flowing out through it.

(Shutter TC2)

Figure 18A:
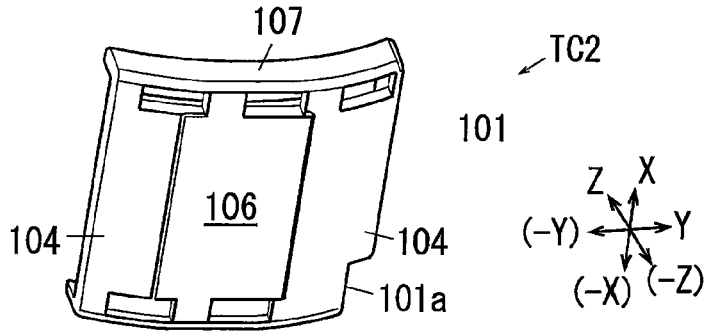
FIGS. 18A and 18B show a shutter.
Figure 18B:
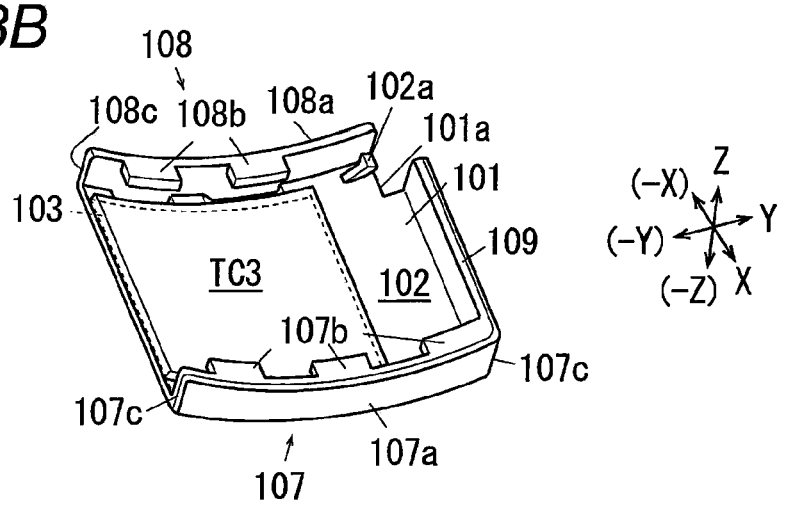
Figure 18C:
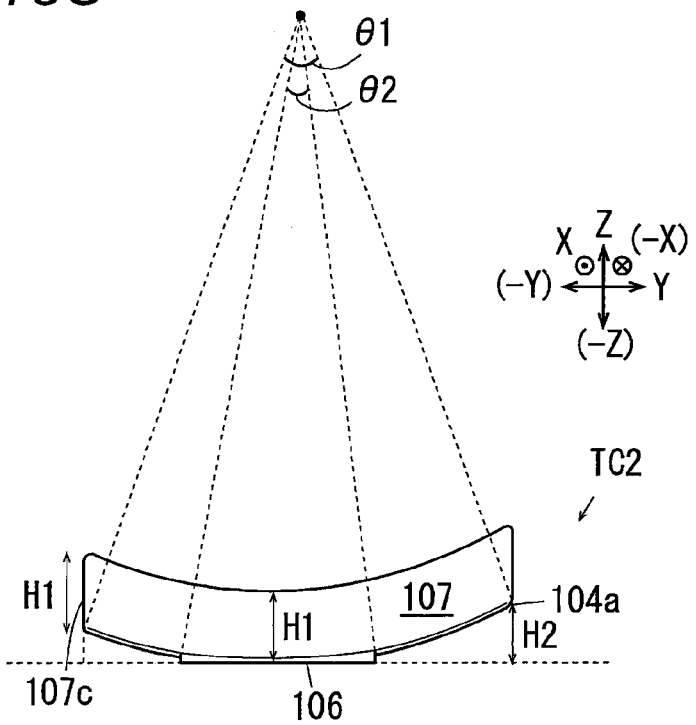
FIG. 18C is an explanatory side view of the shutter.

FIG. 18A is a perspective view of the shutter TC2 as viewed from the outside, FIG. 18B is a perspective view of the shutter TC2 as viewed from the inside, and FIG. 18C is an explanatory side view of the shutter TC2.

As shown in FIGS. 9, 10, and 17, the outlet portion 36 is formed, at the bottom and the front and rear ends, with shutter guides 36*b* and 36*c* (example guide portions) which project forward and rearward, respectively, and extend in the circumferential direction of the cylindrical wall 23 like an arc. As shown in FIGS. 9, 10, and 16, the shutter TC2 (example opening/closing member) is supported by the shutter guides 36*b* and 36*c* so as to be movable between an opening position where it exposes the outlet 36*a* and a closing position where it closes the outlet 36*a*.

As shown in FIG. 17, a cut 36*d* is formed in the outlet portion 36 is formed at a rear-right position of the shutter guide 36*c* so as to extend in the circumferential direction (i.e., extend in a direction from right to left). A rear portion, separated by the cut 36*d*, of the outlet portion 36 serves as an elastic portion 36*e* which is elastically deformable in such directions as to come closer to and go away from the cartridge main body TC1 with a portion adjacent to the left end (tip) of the cut 36*d* as a base. A hook portion 36*f* projects from the tip (right end) of the elastic portion 36*e* in such a direction as to go away from the cartridge main body TC1. The hook portion 36*f* is disposed at such a position as to be able to contact the release portion 11*c* of the shutter housing portion 11 when the toner cartridge TC is inserted into the cartridge holder KH.

As shown in FIGS. 16-18C, the shutter TC2 has a curved-plate-like shutter main body 101 (example opening/closing member main body) which is curved parallel with the outer circumferential surface 23*a* of the cylindrical wall 23. A cut 101*a* on which the hook portion 36*f* of the outlet portion 36 can be hooked is formed in the shutter main body 101 at a rear-right position. As shown in FIG. 18B, an inner surface 102 of the shutter main body 101 is formed, adjacent to the cut 101*a*, a hook subject portion 102*a* which projects inward (toward the inner surface 102) and on which the hook portion 36*f* can be hooked. When the hook portion 36*f* is hooked on the cut 101*a* and the hook subject portion 102*a*, the shutter TC2 is rendered unmovable (i.e., locked). Furthermore, the inner surface 102 of the shutter main body 101 is formed with a seal support portion 103 (example support portion) which supports a sealing member. As shown in FIGS. 18A and 18B, the seal support portion 103 is disposed at such a position as to be deviated clockwise from the center of the inner surface 102 when viewed from the front side so that it can be opposed to the outlet 36*a*.

In the first embodiment, as shown in FIG. 8, the thickness of the shutter main body 101 corresponds to the height difference between bottom surface 11*a* of the shutter housing portion 11 and the inflow surface 13*c*.

As shown in FIG. 16 to FIGS. 18A-18C, an outer surface 104 of the shutter main body 101 is formed with a shutter plane portion 106 (example plane portion) which has a flat surface corresponding to the back side of the seal support portion 103. In the first embodiment, the shutter plane portion 106 has the flat surface at a part being obtained by cutting away a central portion (in the circumferential direction) of the outer surface 104. The shutter plane portion 106 of the first embodiment has the length corresponding to the length of the outer surface 104 in the front-rear direction and, has the length shorter than the length of the outer surface 104 of the entire shutter main body 101 in the right-left direction.

In the first embodiment, for example, the shutter plane portion 106 is formed so as to occupy about ⅔of the outer surface 104 of the shutter main body 101 in the circumferential direction. The central angle 81, in the circumferential direction, of the outer surface 104 of the shutter main body 101 is set at 49° and the central angle θ2, in the circumferential direction, of the shutter plane portion 106 is set at 19°. In the first embodiment, for example, the right-left length of the shutter plane portion 106 is set at 13 mm which is shorter than its front-rear direction.

As shown in FIG. 18B, the shutter main body 101 is formed at the front end and the rear end, front and rear guide subject portions 107 and 108, respectively.

The front guide subject portion 107 is formed with a front guide subject wall 107*a* (example projection) which extends parallel with the front end of the shutter main body 101 and projects inward in the radial direction from the inner surface 102. In particular, in the first embodiment, the front guide subject wall 107*a* projects perpendicularly to the shutter plane portion 106. The height H1 (i.e., the length in the projection direction, or the length in the vertical direction in FIGS. 18B and 18C) of the front guide subject wall 107*a* is constant. As shown in FIG. 18C, right and left end surfaces 107*c* of the front guide subject wall 107*a* is perpendicular to the shutter plane portion 106.

Front guide subject nails 107*b* (example nails) which are guided by (engage with) the shutter guide 36*b* project rearward from the top of the front guide subject wall 107*a*.

The front guide subject wall 107*a* and the front guide subject nails 107*b* constitute the front guide subject portion 107 of the first embodiment.

The rear guide subject portion 108 is symmetrical with the front guide subject portion 107 except that the former is cut at the right end. That is, the rear guide subject portion 108 has a rear guide subject wall 108*a* (example projection), rear guide nails 108*b* (example nails) which are guided by the shutter guide 36*c*, and an end surface 108*c* which correspond to the front guide subject wall 107*a*, the front guide subject nails 107*b*, and the left end surface 107*c*, respectively.

The guide subject portions 107 and 108 are supported movably by the shutter guides 36*b* and 36*c* so that the shutter TC2 can move along the shutter guides 36*b* and 36*c* in the circumferential direction of the outer circumferential surface 23*a* of the cartridge main body TC1.

As shown in FIG. 18C, in a state that the shutter TC2 is placed on a floor surface with the shutter plane portion 106 in contact with the floor surface, the height H1 of the guide subject walls 107*a* and 108*a* is larger than a maximum distance H2 in the vertical direction between the shutter plane portion 106 and the outer surface 104.

That is, as shown in FIG. 18C, the shutter plane portion 106 is deviated from the center of the outer surface 104 in the circumferential direction toward the left side (an example one end in the circumferential direction) and hence the right end 104*a* of the outer surface 104 is most distant from the shutter plane portion 106. Therefore, the height H1 of the guide subject walls 107*a* and 108*a* is larger than the distance H2 between the right end 104*a* of the outer surface 104 and the shutter plane portion 106.

As shown in FIGS. 16-18C, the shutter main body 101 is formed, at the right end, with a shutter stopper 109 (example opening/closing member movement restricting portion). The shutter stopper 109 extends along the right end of the shutter main body 101, projects perpendicularly to the shutter plane portion 106, and is connected to the right end surface 107*c* of the front guide subject wall 107*a*.

When the shutter TC2 is attached to the cartridge main body TC1, the shutter stopper 109 comes into contact with the right end of the outlet portion 36 and is held at the closing position. The shutter stopper 109 thus prevents the shutter TC2 from moving leftward relative to the cartridge main body TC1.

As shown in FIGS. 17 and 18B, a cartridge seal TC3 (example sealing member, example leakage preventive member) is supported by the seal support portion 103 of the shutter TC2.

The cartridge seal TC3, which moves together with the shutter TC2, seals the outlet 36*a* and prevents leakage of developer through the outlet 36*a* when the shutter TC2 is located at the closing position.

(Relationship Between Toner Cartridge TC and Cartridge Holder KH)

As shown in FIGS. 8-11 and 13-15, the cylindrical wall 23 is formed, at a left position, a rib 38 (example projected strip, example link closing portion) which projects leftward (outward in the radial direction) and extends in the front-rear direction. The rib 38 is formed so as to correspond to the projected strip housing recess 12 and hence to be housed in the projected strip housing recess 12 when the toner cartridge TC is inserted in the cartridge housing portion 3.

As shown in FIGS. 5-7, 9, 11, and 12, a cartridge cover 39 (example lid member) which closes the front end of the cylinder portion 22+23 is attached to the front end (in the toner cartridge TC insertion direction (attaching/detaching direction), i.e., in the front-rear direction) of the cartridge main body TC1. As shown in FIGS. 11 and 12, the cartridge cover 39 is attached to the front end of the cartridge main body TC1 (cylindrical wall 23) with a cover seal 39*a* (example leakage preventive member) interposed in between. The front surface of the cartridge cover 39 is formed with a handle 39*b* (example manipulation portion) which extends in the right-left direction in a state that the toner cartridge TC is oriented at the detachable position. Semi-conical handle recesses 39*c* (example manipulation recesses) which are recessed rearward (in the insertion direction of the toner cartridge TC) are formed over and under the handle 39*b*.

As shown in FIG. 12, the handle 39*b* is formed with a circular recess as a bearing portion 39*d* (example shaft support portion) which is recessed forward (in the insertion direction of the toner cartridge TC) from the rear surface. As shown in FIGS. 9-11, the outer circumferential surface of the cartridge cover 39 is formed with a front rib 39*e* (example positioning portion) which extends in the front-rear direction and corresponds to the rib 38. Therefore, the handle 39*b* can be located at the preset position by attaching the cartridge cover 39 to the cylinder portion 22+23 so that the front rib 39*e* is registered with the rib 38. A developer containing room 40 for containing developer (example internal space; see FIG. 8) is formed as a space that is enclosed by the cylinder portion 22+23 and the cartridge cover 39.

The cylinder portion 22+23 and the cartridge cover 39 constitute the cartridge main body TC1 (example detachable body main body of the first embodiment).

As shown in FIGS. 8 and 11-15, an agitator 41 (example developer transport member) is housed in the developer containing room 40. The agitator 41 has a rotary shaft 42 which extends in the front-rear direction (toner cartridge TC insertion direction). A rear end portion 42*a* of the rotary shaft 42 is connected to the follower coupling 25, and a front end portion 42*b* of the rotary shaft 42 is supported rotatably by the bearing portion 39*d*. Therefore, the rotary shaft 42 is rotated when receiving drive power from the cartridge motor 17.

A central portion 42*c* of the rotary shaft 42 is a square pillar which extends in the front-rear direction. A pair of (front and rear) mushroom-shaped film fixing projections 42*d* (example transport member fixing portions) which are spaced from each other in the front-rear direction project in the radial direction from one surface of the central portion 42*c*. Rod-shaped agitating portions 42*e* project from the surface of the central portion 42*c* opposite to the surface from which the film fixing projections 42*d* project. The rod-shaped agitating portions 42*e* are rotated together with the rotary shaft 42, and thereby agitate the developer contained in the developer containing room 40 or break lumps of developer.

As shown in FIGS. 11 and 12, a transport film 43 (example developer transport member) which is a thin-film flexible member is supported by the film fixing projections 42*d* of the rotary shaft 42. As shown in FIG. 11, the transport film 43 is supported in such a manner that the film fixing projections 42*d* penetrate through attachment holes 43*a* (example fixing subject portions) which are formed on the center line of the transport film 43. The transport film 43 is thus rotated together with the rotary shaft 42. As shown in FIG. 12, the transport film 43 has a trapezoidal rear cut 43*b* which is formed so as to conform to the transmission housing portion 22*a*, at the rear end in the insertion direction of the toner cartridge TC. The transport film 43 also has a trapezoidal front cut 43*c* which is formed so as to conform to the inner surfaces of the handle recesses 39*c*, at the front end in the insertion direction of the toner cartridge TC. Therefore, when the rotary shaft 42 is rotated, the transport film 43 transports the developer toward the outlet 36*a* in a state that it is in contact with the inner circumferential surface of the cylindrical wall 23 and is thereby deformed elastically. In the first embodiment, the transport film 43 covers both sides of the rotary shaft 42 in the radial direction and hence transports the developer toward the outlet 36*a* twice per one rotation. As a result, the amount of developer that flows out through the outlet 36*d* in a unit time (i.e., dispense rate) tends to be stable.

(Assembling Machine AT)

(Parts Feeder PF)

Figure 19:
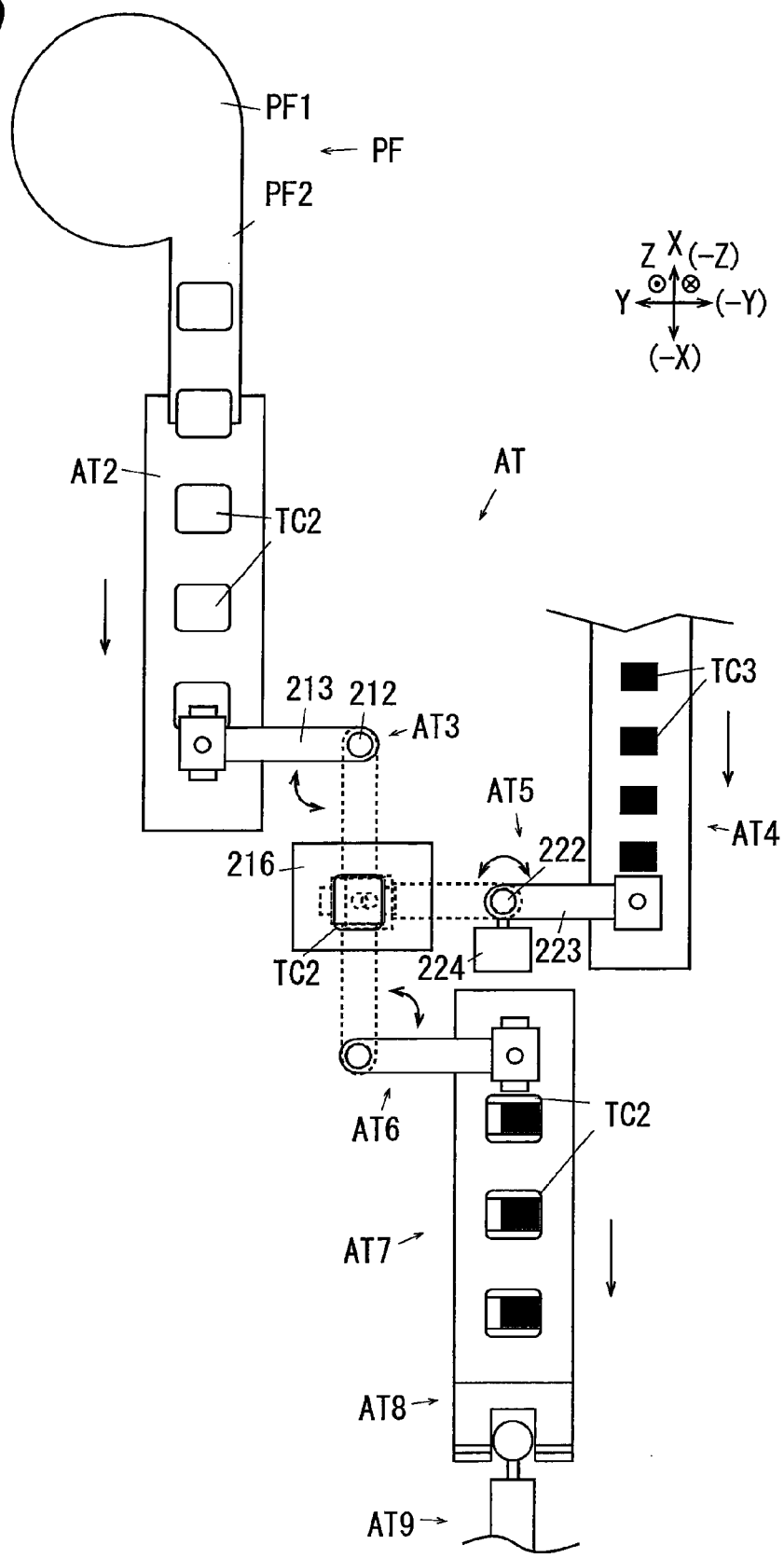
FIG. 19 illustrates an assembling machine according to the first embodiment.
Figure 20:
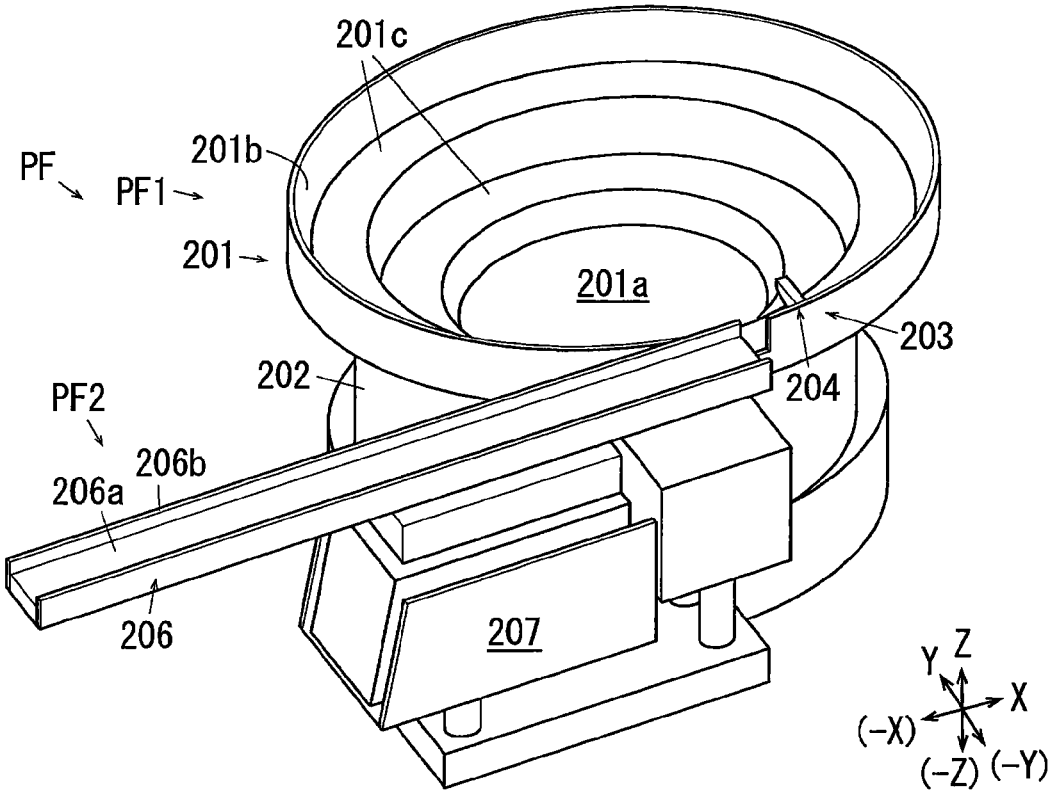
FIG. 20 shows a parts feeder according to the first embodiment.

FIG. 19 illustrates an assembling machine AT according to the first embodiment. FIG. 20 shows a parts feeder PF according to the first embodiment.

As shown in FIG. 19, a large number of shutters TC2 of the first embodiment are produced by a molding machine (mot shown) and then automatically attached to cartridge main bodies TC1 etc. by the assembling machine AT.

As shown in FIGS. 19 and 20, the assembling machine AT has a parts feeder PF (example parts supply apparatus). The parts feeder PF is equipped with a bowl feeder PF1 (example upstream supply device) and a linear feeder PF2 (example downstream supply device) for conveying parts downstream that are supplied from the bowl feeder PF1.

The bowl feeder PF1 is equipped with a bowl 201 (example container) and a vibrating unit 202 which supports the bottom of the bowl 201.

A bottom portion 201*a* of the bowl 201 is configured so as to be able to contain a large number of shutters TC2 (example part(s)). A side inner surface 201*b* of the bowl 201 is formed with a spiral surface 201*c* which extends spirally upward from the bottom surface 201*a*.

On the other hand, the vibrating unit 202 (example vibration source) is constructed using an electromagnet and an elastic plate so as to be able to vibrate obliquely with respect to the floor surface. The vibrating unit 202 vibrates the bowl 201 at such a preset natural frequency that shutters TC contained in the bowl 201 go up along the spiral surface 201*c*.

Apparatus for conveying parts using vibration such as the above-described one are already known and in public use. For example, parts feeders can be employed that are described in the electronic information "Parts feeders (general)," NTN Corporation, Internet site having the URL http://www.ntn.co.jp/japan/products/catalog/pdf/partsfeeder/pdf/Parts-Feeder.pdf (searched on Jun. 28, 2010). Therefore, the parts feeder PF will not be described in detail below.

Figure 21A:
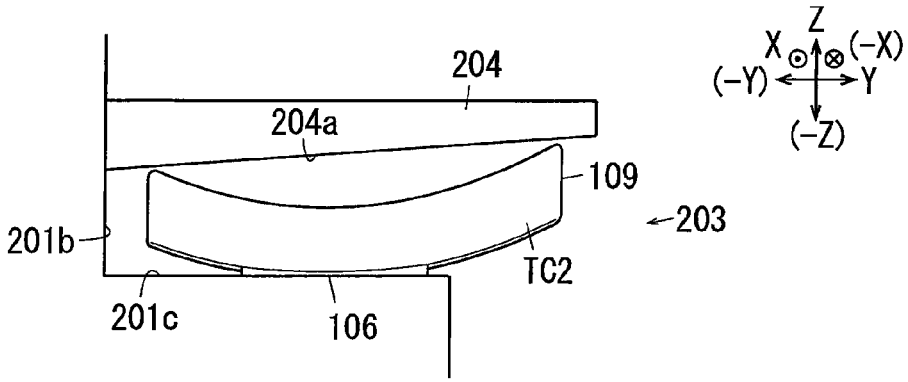
FIGS. 21A-21C illustrate how shutters TC2 are conveyed by a parts feeder.
Figure 21B:
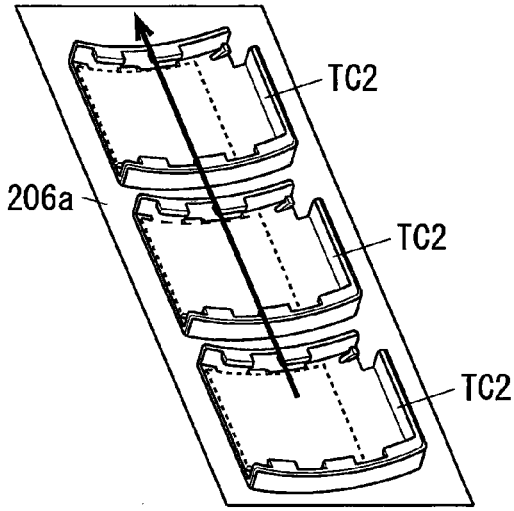
Figure 21C:
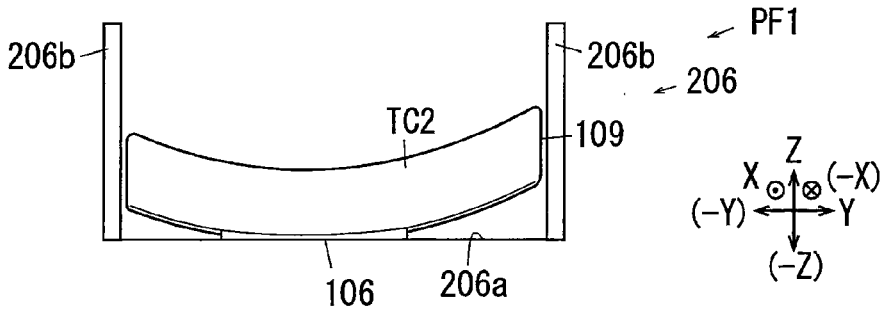

FIGS. 21A-21C illustrate how shutters TC2 are conveyed by the parts feeder PF. More specifically, FIG. 21A shows a relationship between a sorting block 204 and a shutter TC2, FIG. 21B shows shutters TC2 being conveyed by a linear conveying unit 206, and FIG. 21C shows relationships between a shutter TC2 being conveyed and a conveyance surface 206*a* and guide walls 206*b*.

As shown in FIG. 20, a sorting area 203 is set downstream of the spiral surface 201. As shown in FIG. 21A, the sorting block 204 (example sorting member) is disposed over the spiral surface 201*c* in the sorting area 203. The sorting block 204 is formed with a bottom surface 204*a* which is inclined so as to go down as the position goes from the right end to the left end.

If a shutter TC2 has a standard posture shown in FIG. 21A in which the shutter plane portion 106 (bottom surface) is in contact with the spiral surface 201*c* and the shutter stopper 109 is located on the right side (when viewed from behind in the traveling direction), the shutter TC2 passes the sorting area 203 without contacting the bottom surface 204*a* and is then supplied to the linear feeder PF2. If the posture of a shutter TC2 is different from the above one (e.g., oriented differently or flipped), the shutter TC2 comes into contact with the sorting block 204 and is thereby posture-corrected to the standard posture or dropped from the spiral surface 201*c* to the bottom portion 201*a*.

As shown in FIGS. 20 and 21B, the linear feeder PF2 is equipped with the linear conveying unit 206 for conveying shutters TC2 supplied from the bowl feeder PF1 and a vibrating unit 207 which supports the bottom of the linear conveying unit 206.

The linear conveying unit 206 has the conveyance surface 206*a* which extends straightly and guide walls 206*b* (example guide members) which are formed on both sides of the conveyance surface 206*a* perpendicularly to the conveyance surface 206*a*.

The vibrating unit 207 vibrates the linear conveying unit 206 at such a preset natural frequency that shutters TC2 are moved along the conveyance surface 206*a*.

As a result, in the linear conveying unit 206, a shutter TC2 having the standard posture that is supplied from the bowl feeder PF1 is supplied to a downstream first conveyer AT2 (example first parts conveying apparatus) while being guided by the guide walls 206*b* and maintaining the standard posture.

Figure 22A:
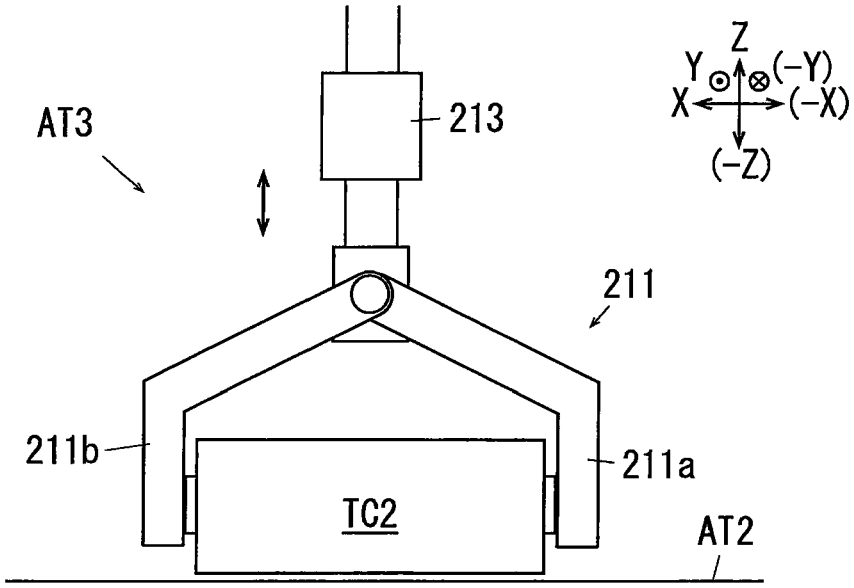
FIGS. 22A and 22B show a first conveying arm of the first embodiment in a state that it is gripping a part (shutter) and in a state that it has released the part; respectively.
Figure 22B:
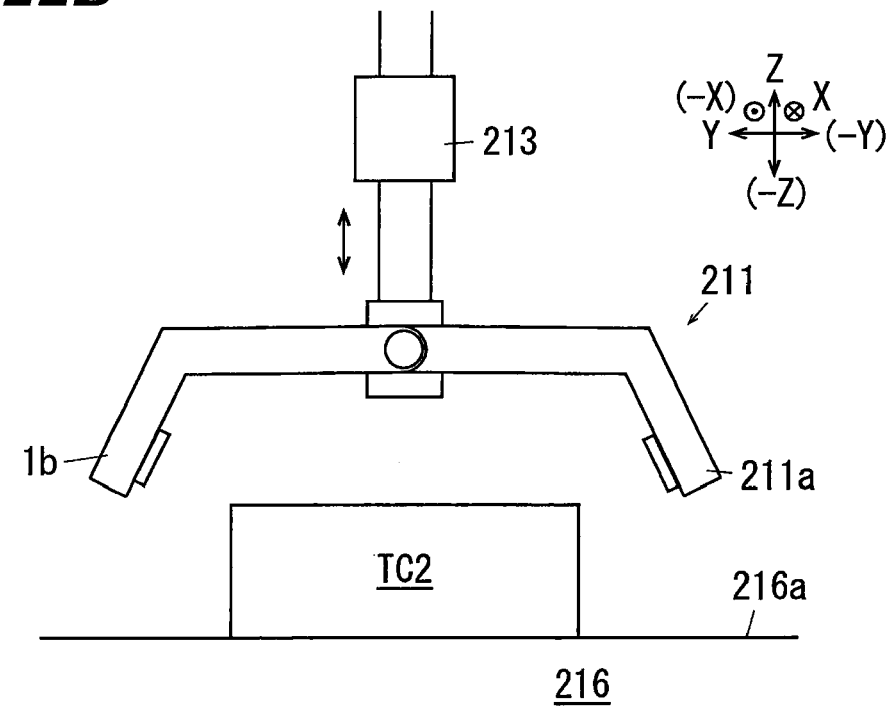

FIGS. 22A and 22B show a first conveying arm AT3 of the first embodiment in a state that it is gripping a part (shutter TC2) and in a state that it has released the part, respectively.

As shown in FIG. 19, shutters TC2 supplied from the parts feeder PF are conveyed to the first conveying arm AT3 (example first position switching apparatus) by the first conveyer AT2.

As shown in FIG. 19 and FIGS. 22A and 22B, the first conveying arm AT3 is equipped with a hand 211 (example gripping member) which can hold a shutter TC2 by gripping it and an arm 213 (example support arm member) which supports the hand 211 so as to be able to elevate and lower it and is supported so as to be rotatable on a rotary shaft 212.

The hand 211 has main bodies 211*a* and 211*b* (example pair of gripping member main bodies) which are configured so as to come close to and go away from each other and to be movable between gripping positions (FIG. 22A) where they hold a shutter TC2 by gripping it in the front-rear direction and release positions (FIG. 22B) where they release the shutter TC2 by going away from the shutter TC2.

On the other hand, the arm 213 is supported so as to be rotatable between a pickup position (indicated by a solid line in FIG. 19) where it picks up a shutter TC2 from the first conveyer AT2 and a setting position (indicated by a broken line in FIG. 19) where it sets the picked-up shutter TC2 on a setting stage 216 (example working stage).

In the first conveying arm AT3, the arm 213 is moved to the pickup position so as to be timed with arrival of a shutter TC2 and the hand 211 is lowered to the gripping position and grips and holds the shutter TC2 on the first conveyer AT2. Then, the hand 211 is elevated, moved to the setting position, and lowered to the release position. Finally, the shutter TC2 is placed on a horizontal top surface 216*a* of the setting stage 216.

Figure 23A:
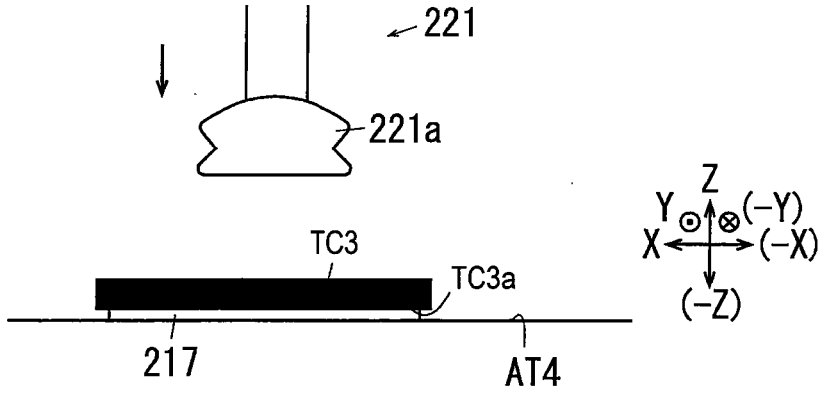
FIGS. 23A-23C show an absorption head of a seal sticking apparatus before absorption of a part (cartridge seal), in a state that the part is absorbed, and before sticking of the part, respectively.
Figure 23B:
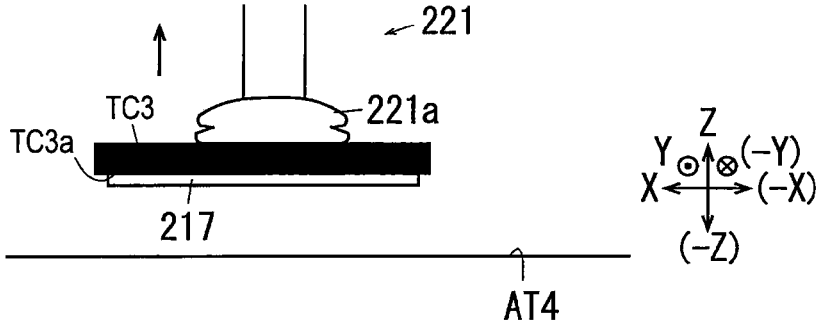
Figure 23C:
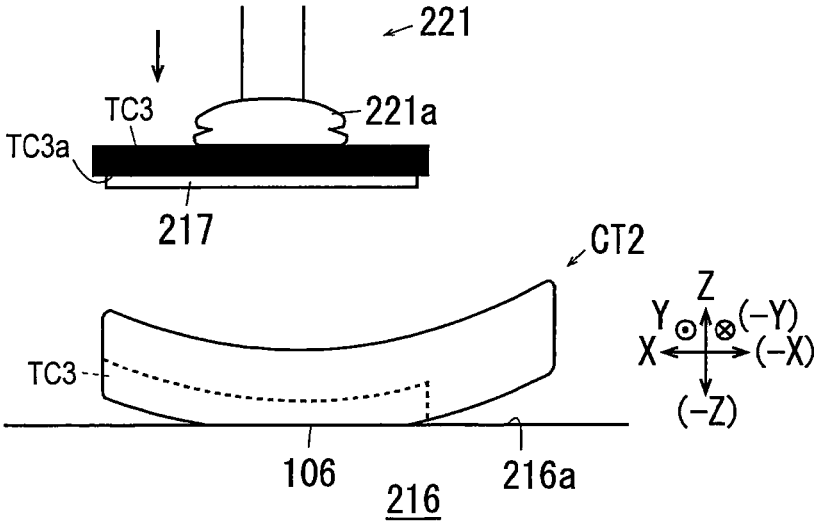

FIGS. 23A-23C show an absorption head 221 of a seal sticking apparatus AT5 before absorption of a part (cartridge seal TC3), in a state that the part is absorbed, and before sticking of the part, respectively.

As shown in FIG. 19, a second conveyer AT4 (example second parts conveying apparatus) is installed on the right of the setting stage 216. The second conveyer AT4 conveys cartridge seals TC3 (example second parts) which are supplied by a parts supply apparatus (not shown). As shown in FIGS. 23A-23C, a double-sided adhesive tape 217 (example adhesive member) has adhered to a bottom surface TC3*a* of each cartridge seal TC3 in advance by an apparatus for that purpose (not shown). Each cartridge seal TC3 is conveyed to the seal sticking apparatus AT5 (example sticking apparatus) by the second conveyer AT4.

The surface of the second conveyer AT4 has been processed so that it is highly releaseable and hence the double-sided adhesive tape 217 hardly sticks to it. Therefore, when a cartridge seal TC3 is moved upward from the second conveyer AT4, the double-sided adhesive tape 217 is kept stuck to the cartridge seal TC3 (i.e., moved upward together with it).

A cartridge seal TC3 is stuck to a shutter TC2 placed on the setting stage 216, by the seal sticking apparatus AT5.

As shown in FIGS. 19 and 23A-23C, the seal sticking apparatus AT5 is equipped with the absorption head 221 (example parts absorbing device) whose tip portion is formed with gas passage holes, an arm 223 which supports the absorption head 221 so as to be able to elevate and lower it and is supported rotatably on a rotary shaft 222, and a sucking device 224 which can suck gas through the holes of the absorption head 221 and discharge gas.

As shown in FIGS. 23A-23C, the absorption head 221 is equipped with a sucker portion 221*a* which is formed with the above-mentioned holes. The sucker portion 221*a* absorbs a cartridge seal TC3 (see FIG. 23B) when the sucker portion 221*a* is brought into contact with the cartridge seal TC3 (example second part) and the sucking device 224 sucks gas to produce negative pressure in the space between the sucker portion 221*a* and the cartridge seal TC3. The sucker portion 221*a* releases the cartridge seal TC3 when the sucking device 224 discharges gas to restore ordinary pressure in the space between the sucker portion 221*a* and the cartridge seal TC3.

On the other hand, the arm 223 is supported so as to be rotatable between an absorbing position (indicated by a solid line in FIG. 19) where it picks up a cartridge seal TC3 from the second conveyer AT4 and a sticking position (indicated by a broken line in FIG. 19) where it sticks the cartridge seal TC3 to a shutter TC2.

In the seal sticking apparatus AT5, the arm 223 is moved to the sticking position so as to be timed with arrival of a cartridge seal TC3 and the absorption head 221 is lowered, comes into contact with the cartridge seal TC3, and absorbs it. Then, the absorption head 221 is elevated and the arm 223 is moved to the sticking position. Then, the absorption head 221 is lowered, whereby the double-sided adhesive tape 217 of the cartridge seal TC3 is pressed against the seal support portion 103 of a shutter TC2. As a result, the cartridge seal TC3 is stuck to the shutter TC2 with the double-sided adhesive tape 217. Then, the absorption head 221 releases the cartridge seal TC3 and is elevated.

As shown in FIG. 19, the shutter TC2 to which the cartridge seal TC3 has been stuck is conveyed to a third conveyer AT7 (example third parts conveying apparatus) by a second conveying arm AT6 (example second position switching apparatus). The second conveying arm AT6 is configured in the same manner as the first conveying arm AT3 except that the former conveys a shutter TC2 from the setting stage 216 to the third conveyer AT7, and hence will not be described in detail.

The third conveyer AT7 conveys shutters TC2 to which cartridge seals TC3 are stuck to an erecting slope unit AT8 (example posture converting member).

Figure 24A:
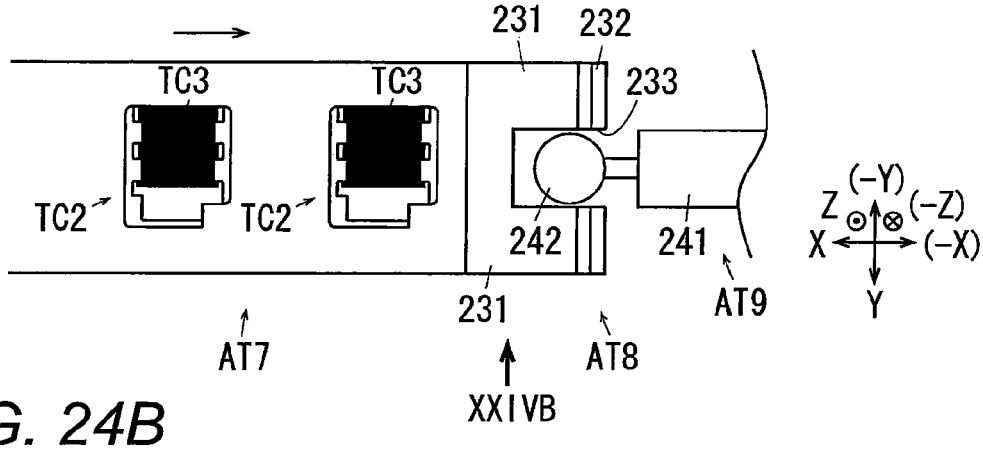
FIGS. 24A-24C show an erecting slope unit and a pickup absorption head which are used in the first embodiment.
Figure 24B:
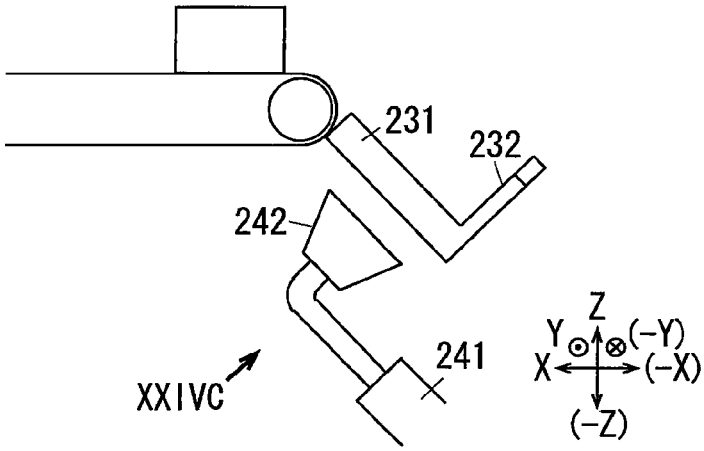
Figure 24C:
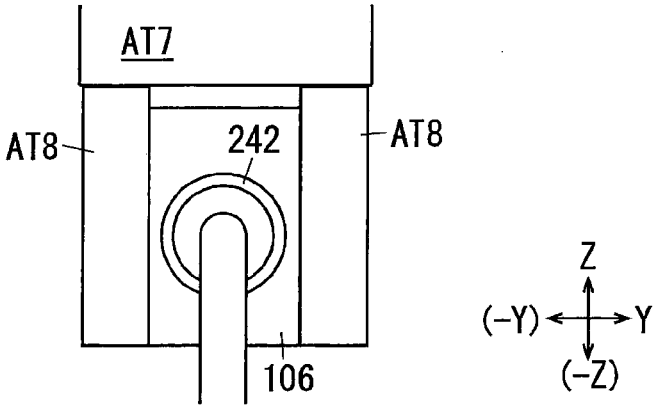

FIGS. 24A-24C show the erecting slope unit AT8 and a pickup absorption head 242 which are used in the first embodiment of the invention. More specifically, FIG. 24A is an enlarged view of an important part of FIG. 19, FIG. 24B is a side view as viewed from the direction XXIVB in FIG. 24A, and FIG. 24C is a view as viewed from the direction XXIVC in FIG. 23B.

As shown in FIGS. 24A-24C, the erecting slope unit AT8 has a slope 231 (example inclined surface) which is inclined so as to go down from the downstream end of the third conveyer AT7. The top surface of the slope 231 is a concave surface that conforms to the outer surface 104 and the shutter plane portion 106 of the shutter TC2. A stop wall 232 projects obliquely upward from the bottom of the slope 231. A head passage hole 233 (example passage hole) is formed in the slope 231 and the stop wall 232 at the center in the right-left direction so as to correspond to the shutter plane portion 106. In the first embodiment, the head passage hole 233 is formed so as to be wider in the right-left direction than the shutter plane portion 106.

As shown in FIGS. 24A-24C, after being conveyed to the erecting slope unit AT8 by the third conveyer AT7, a shutter TC2 falls along the top surface of the slope 231 and comes into contact with the stop wall 232, whereby the shutter TC2 is stopped in a state that it is erected obliquely leaning against the top surface of the slope 231.

In this state, as shown in FIG. 24C, the shutter TC2 is held in such a manner that the shutter plane portion 106 is exposed to the lower side through the head passage hole 233.

As shown in FIGS. 19 and 24C, the shutter TC2 being held by the erecting slope unit AT8 is picked up by the pickup absorption apparatus AT9 (example pickup apparatus).

The pickup absorbing apparatus AT9 is equipped with a pickup arm 241 (example pickup apparatus main body) having plural support arm members and joints and the pickup absorption head 242 (example second parts absorbing device) which is supported by the tip of the pickup arm 241. The pickup absorption head 242 approaches and comes into contact with the shutter plane portion 106, exposed through the head passage hole 233, of the shutter TC2 being held on the erecting slope unit AT8 and absorbs the shutter TC2. Then, the pickup absorption head 242 passes the head passage hole 233 of the erecting slope unit AT8 upward and thereby picks up the shutter TC2 from the slope 231.

In the first embodiment, the pickup absorption head 242 is a commonly used absorption head and has a diameter 12 mm. The manners of absorption and release of the pickup absorption head 242 can be the same as those of the absorption head 221 (described above) and hence will not be described in detail.

After picking up the shutter TC2, the pickup absorbing apparatus AT9 attaches it to a cartridge main body TC1 that has been conveyed by a parts conveying apparatus (not shown).

The assembling apparatus AT according to the first embodiment is made up of the members, apparatus, etc. denoted by symbols PF, AT2-AT9, etc.

(Workings of First Embodiment)

In the printer U according to the first embodiment having the above configuration, the toner cartridge TC is attached to the cartridge holder KH in the following manner. The toner cartridge TC is inserted into the cartridge holder KH with the outlet portion 36 registered with the shutter housing portion 11, that is, the toner cartridge TC is moved from a detached position shown in FIG. 5 to the attached position shown in FIG. 6. During that course, the hook portion 36*f* of the toner cartridge TC is pushed by the release portion 11*c* of the shutter housing portion 11 of the cartridge holder KH and thereby disengaged from the cut 101*a* and the hook subject portion 102*a*. The shutter TC2 is thus rendered movable.

When the toner cartridge TC which is inserted in the cartridge holder KH is thereafter rotated from the unlock position shown in FIG. 6 to the positioning position shown in FIG. 7, the cartridge main body TC1 is rotated whereas the shutter TC2 remains in the shutter housing portion 11 because the shutter TC2 hits the step formed by the bottom surface 11*a* of the shutter housing portion 11 and the inflow surface 13*c* and is thereby prevented from rotation. That is, the shutter TC2 is moved relative to the outlet portion 36 in the circumferential direction (example movement direction) from the closing position for closing the outlet 36*a* (see FIG. 13) to the opening position for exposing the outlet 36*a* (see FIG. 8). During that course, the inlet shutter 14 of the cartridge holder KH is pushed by the outlet portion 36 which is moving toward the position corresponding to the positioning position and thereby moved from the closing position for closing the inlet 13*d* (see FIG. 5) to the opening position for exposing the inlet 13*d* (see FIG. 8).

As a result, a state is established that the outlet 36*a* and the inlet 13*d* are exposed and connected to each other and hence developer can be supplied.

To detach the toner cartridge TC to, for example, replace the toner cartridge TC or perform maintenance work or inspection, the toner cartridge TC is rotated from the positioning position shown in FIGS. 7, 8, 15, etc. to the unlock position shown in 6, 14, etc.

During that course, the shutter TC2 is held in the shutter housing portion 11 in a non-rotatable state and is moved relative to the rotating outlet portion 36 to reach the closing position. The inlet shutter 14 is pushed by the rib 38 etc. of the rotating toner cartridge TC and thereby moved to the inlet 13*d* opening position to the closing position. In this manner, as the toner cartridge TC is rotated from the positioning position to the unlock position, the shutters 14 and TC2 are moved to the closing positions and close the inlet 13*d* and the outlet 36*a*, respectively.

The toner cartridge TC that has been rotated to the unlock position can be detached from the cartridge holder KH. During the action of detaching the toner cartridge TC, the hook portion 36*f* is disengaged from the release portion 11*c* of the cartridge holder KH and hooked on the cut 101*a* and the hook subject portion 102*a*. The shutter TC2 is thus locked.

As shown in FIG. 19 to FIGS. 24A-24C, the toner cartridge TC of the first embodiment is assembled by the assembling machine AT.

As shown in FIG. 19 to FIGS. 21A-21C, many shutters TC2 are contained in the bowl 201 of the bowl feeder PF1 of the parts feeder PF. When the bowl 201 is vibrated by the vibrating unit 202, part of the shutters TC2 goes up along the spiral surface 201*c* and the other part of the shutters TC remain in the bottom portion 201*a* while rotating. The shutters TC that are going up along the spiral surface 201*c* have various postures. Only shutters TC having the standard posture are selected by the sorting block 204 provided in the sorting area 203, and are supplied to the linear feeder PF2.

In a conventional shutter which does not have the shutter plane portion 106 and in which the entire outer surface are curved, its posture is not apt to be stable when it is moved with the outer surface as a bottom surface. In particular, in the bowl feeder PF1, since the spiral surface 201*c* is vibrated, conventional shutters are not apt to be stable and may come off the spiral surface 201*c* halfway as they go up. That is, even if set in advance so as to have the standard posture, conventional shutters may come off the spiral surface 201*c* before reaching the sorting area 203. It is likely that the number of shutters supplied in a unit time decreases.

In contrast, according to the first embodiment, since the shutter TC2 is formed with the shutter plane portion 106 and moved with the shutter plane portion 106 as a bottom surface, its posture is apt to be stable and it is unlikely that the number of shutters supplied in the unit time decreases.

As shown in FIGS. 18C and 21A, the shutter TC2 of the first embodiment has the guide subject walls 107*a* and 108*a* and the height H1 of the guide subject walls 107*a* and 108*a* is larger than the maximum distance H2 in the vertical direction between the shutter plane portion 106 and the outer surface 104.

Therefore, when, for example, two shutters TC2 are being conveyed in close proximity with the shutter plane portions 106 down, an event that one shutter TC2 goes up onto the other, that is, the other shutter TC2 enters the gap between the one shutter TC2 and the spiral surface 201*c*, can be prevented because the guide subject wall 107*a* or 108*a* of the other shutter TC2 which are longer than the gap hit the guide subject wall 108*a* or 107*a* of the one shutter TC2.

That is, in the first embodiment, adjoining shutters TC2 are less prone to be put one on another even if plural shutters TC2 are conveyed in close proximity than in a case that the height H1 of the guide subject walls 107*a* and 108*a* is shorter than the maximum distance H2 in the vertical direction between the shutter plane portion 106 and the outer surface 104.

As shown in FIGS. 18C and 21A, in the shutter TC2 according to the first embodiment, the shutter plane portion 106 is located at the position that is deviated from the center of the outer surface 104 in the circumferential direction. Therefore, when having the standard posture, the shutter TC2 is conveyed in a state that it is asymmetrical with respect to the center plane that is perpendicular to the circumferential direction.

If the shutter plane portion 106 were formed at the center, in the circumferential direction, of the outer surface 104 of the shutter TC2, when the shutter TC2 has the standard posture, both ends, in the circumferential direction, of the outer surface 104 would have the same height and the shutter TC2 would be kept symmetrical with respect to the center plane that is perpendicular to the circumferential direction. Therefore, when conveyed to the sorting area 203, not only shutters TC2 having the standard posture but also shutters TC2 that are rotated 180° from the standard posture may pass the sorting area 203 without touching the bottom surface 204*a* of the sorting block 204.

In contrast, in the shutter TC2 of the first embodiment, when it has the standard posture, it is kept asymmetrical with respect to the center plane that is perpendicular to the circumferential direction. And the shutter TC2 has different cross sections taken perpendicularly to the traveling direction when it has the standard posture and when it does not. Therefore, as long as the sorting block 204 is formed and disposed so as to be suitable for the standard posture, only shutters TC2 having the standard posture pass the sorting area 203. Shutters TC2 not having the standard posture touch the bottom surface 204*a* of the sorting block 204 and are thereby blocked. As such, though simple in configuration, the first embodiment makes it possible to sort shutters TC2 into ones having the standard posture and ones not having the standard posture more accurately than in the case where the shutter plane portion 106 is formed at the center, in the circumferential direction, of the outer surface 104 of the shutter TC2.

As shown in FIGS. 19, 21B, and 21C, the linear feeder PF2 of the parts feeder PF receives shutters TC2 having the standard posture from the bowl feeder PF1 and conveys the shutters TC2 in such a manner they keep the standard posture as the vibrating unit 207 vibrates the linear conveying unit 206.

In the first embodiment, since the right and left end surfaces, extending parallel with the traveling direction, of the shutter TC2 are perpendicular to the shutter plane portion 106, the shutter TC2 is moved on the conveyance surface 206*a* with the right and left end surfaces kept parallel with the guide walls 206*b*. The shutter TC2 thus tends to keep the standard posture.

In the shutter TC2 of the first embodiment, the guide subject walls 107*a* and 108*a* which are set perpendicular to the traveling direction are perpendicular to the shutter plane portion 106. Therefore, when, for example, two shutters TC2 are being conveyed in close proximity and the guide subject wall 107*a* of the upstream shutter TC2 hits the guide subject wall 108*a* of the downstream shutter TC2, an event that one shutter TC2 goes up onto or is placed on the other is less likely to occur than in a case that the guide subject walls 107*a* and 108*a* are slanted with respect to (i.e., not perpendicular to) the shutter plane portion 106.

As shown in FIGS. 18A-18C, FIGS. 22A and 22B, and FIGS. 23A-23C, shutters TC2 supplied from the parts feeder PF are conveyed by the first conveyer AT2 and a shutter TC2 is moved from the first conveyer AT2 to the setting stage 216 and set there by the first conveying arm AT3.

As shown in FIGS. 18A-18C and 23A-23C, when the shutter TC2 is set on the setting stage 216, the seal sticking apparatus AT5 sticks, to the shutter TC2 on the setting stage 216, a cartridge seal TC3 that has been conveyed by the second conveyer AT4.

As shown in FIGS. 23A-23C, the seal sticking apparatus AT5 sticks the cartridge seal TC3 to the shutter TC2 by pressing the former against the latter in a state that the double-sided adhesive tape 217 of the cartridge seal TC3 is opposed to the seal support portion 103 of the shutter TC2.

At this time, in the first embodiment, the shutter TC2 is placed on the top surface 216*a* of the setting stage 216 with the shutter plane portion 106 as a bottom portion and the setting stage 216 is kept in contact with the top surface 216*a*.

In the conventional shutter in which the entire outer surface is curved, the shutter may swing when it is set on the setting stage 216 with the outer surface as a bottom surface, resulting in an event that a cartridge seal TC3 is stuck to the swinging shutter and a deviation occurs between the cartridge seal TC3 and the seal support portion 103. Furthermore, when the conventional shutter is set on the setting stage 216 with the outer surface as a bottom surface and force is exerted from the side of the seal support portion 103 to stick a cartridge seal TC3, shutter may be inclined depending on the force exerting position, resulting in an event that the cartridge seal TC3 is pressed unevenly and stuck to the shutter incompletely.

In contrast, in the shutter TC2 of the first embodiment, since the shutter TC2 is placed on the top surface 216*a* of the setting stage 216 with the shutter plane portion 106 in contact with the top surface 216*a*, the shutter TC2 is not prone to swing on the setting stage 216 and is not prone to be inclined even if force is exerted from the side of the seal support portion 103. In particular, in the first embodiment, since the shutter plane portion 106 is formed so as to correspond to the back side of the seal support portion 103, the shutter TC2 tends to be pressed against the setting stage 216 with the shutter plane portion 106 kept in contact with the top surface 216*a* even if force is exerted from the side of the seal support portion 103. The shutter TC2 is more apt to maintain its posture than in a case that the shutter plane portion 106 is not formed so as to correspond to the back side of the seal support portion 103.

In conclusion, in the shutter TC2 of the first embodiment, when the cartridge seal TC3 is stuck to the shutter TC2 by pressing the former against the latter from the side of the seal support portion 103, the probability of occurrence of positional deviation of the cartridge seal TC3 is lower and the cartridge seal TC3 is more apt to be stuck completely than in the conventional shutter.

As shown in FIGS. 19 and 24A-24C, when the cartridge seal TC3 has been stuck to the shutter TC2, the second conveying arm AT6 moves the shutter TC2 to the third conveyer AT7, which conveys the shutter TC2 to the erecting slope AT8.

As shown in FIGS. 24A-24C, when the shutter TC2 has been conveyed to the erecting slope AT8, the pickup absorbing apparatus AT9 absorbs and picks up the shutter TC2 which has been erected by the erecting slope AT8 and attaches it to a cartridge main body TC1.

In the pickup absorbing apparatus AT9 of the first embodiment, the pickup absorption head 242 picks up the shutter TC2 from the erecting slope AT8 by absorbing the shutter plane portion 106 of the shutter TC2. In particular, in the first embodiment, the shutter plane portion 106 is wider than 12 mm and the pickup absorption head 242 is a common absorption head having a diameter 12 mm.

If it is attempted to pick up the conventional shutter whose entire outer surface is curved or a shutter whose shutter plane portion 106 is narrower than 12 mm by means of the pickup absorbing apparatus AT9 of the first embodiment which is equipped with a common absorption head having a diameter 12 mm, it would be difficult to pick up the shutter, that is, absorption would be insufficient or the shutter would come off after absorption, because the absorption head absorbs the curved outer surface or sticks out of the shutter plane portion 106 and absorbs parts of the outer surface 104. Therefore, to pick up the conventional shutter or a shutter whose shutter plane portion 106 is narrower than 12 mm by means of the pickup absorbing apparatus AT9 of the first embodiment, it is necessary to manufacture a special absorption head that is suitable for the shape of the conventional shutter or the width of the shutter plane portion 106.

In contrast, in the embodiment, since the shutter plane portion 106 is wider than 12 mm and hence a common absorption head having a diameter 12 mm is usable, the cost of the pickup absorbing apparatus AT9 can be made lower than in cases where the shutter plane portion 106 that is wider than 12 mm is not used.

In the first embodiment, since the shutter plane portion 106 is formed so as to occupy about 2/5 of the entire outer surface 104 of the shutter main body 101, the area ratio of the shutter plane portion 106 to the shutter main body 101 is not too large and appropriate thickness balance is secured. As a result, the probability of occurrence of a molding failure (sink) tends to be low.

[Embodiment 2]

Figure 25:
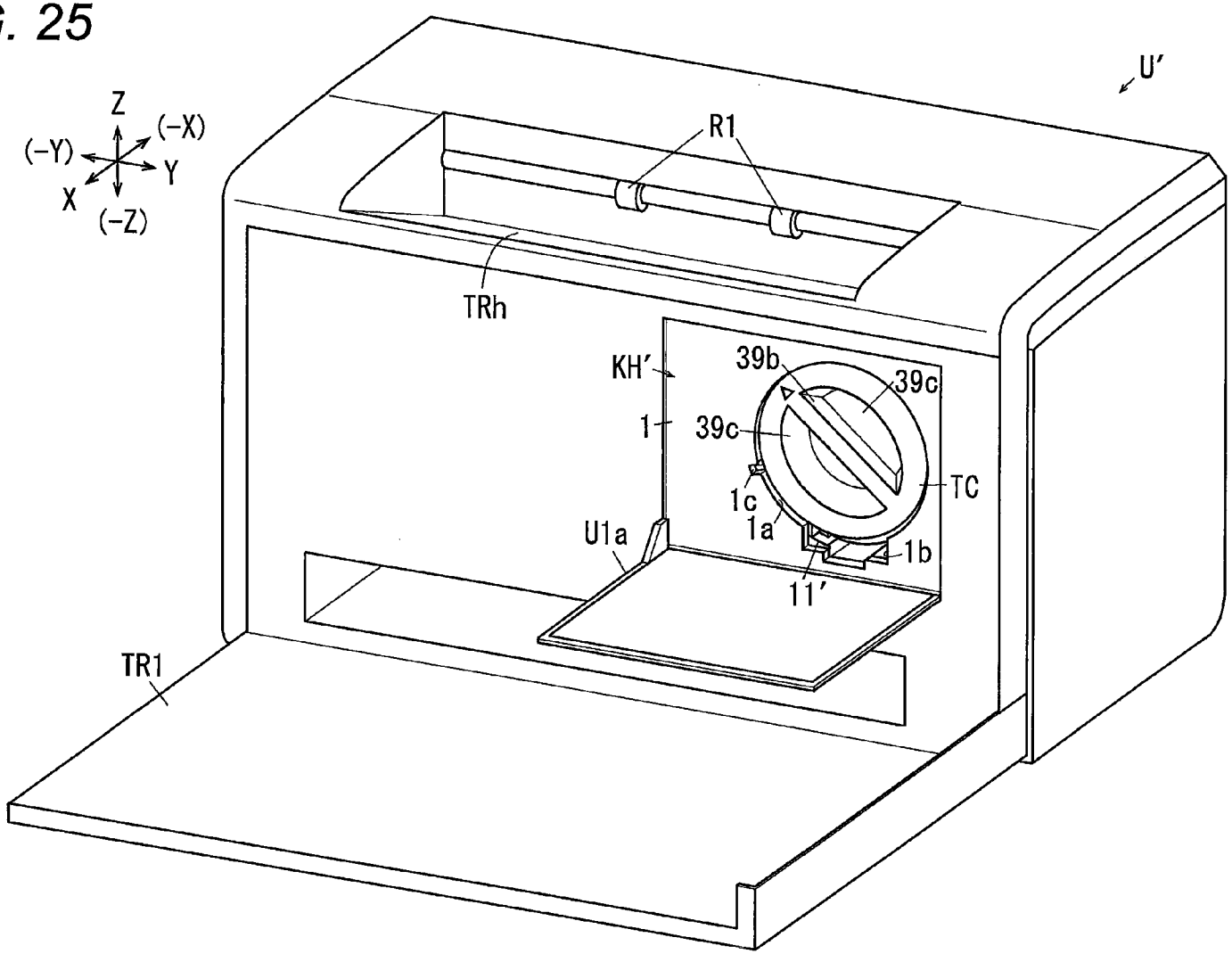
FIG. 25, which corresponds to FIG. 3 (first embodiment), shows a state that the front cover of an image forming apparatus according to a second embodiment is opened.
Figure 26A:
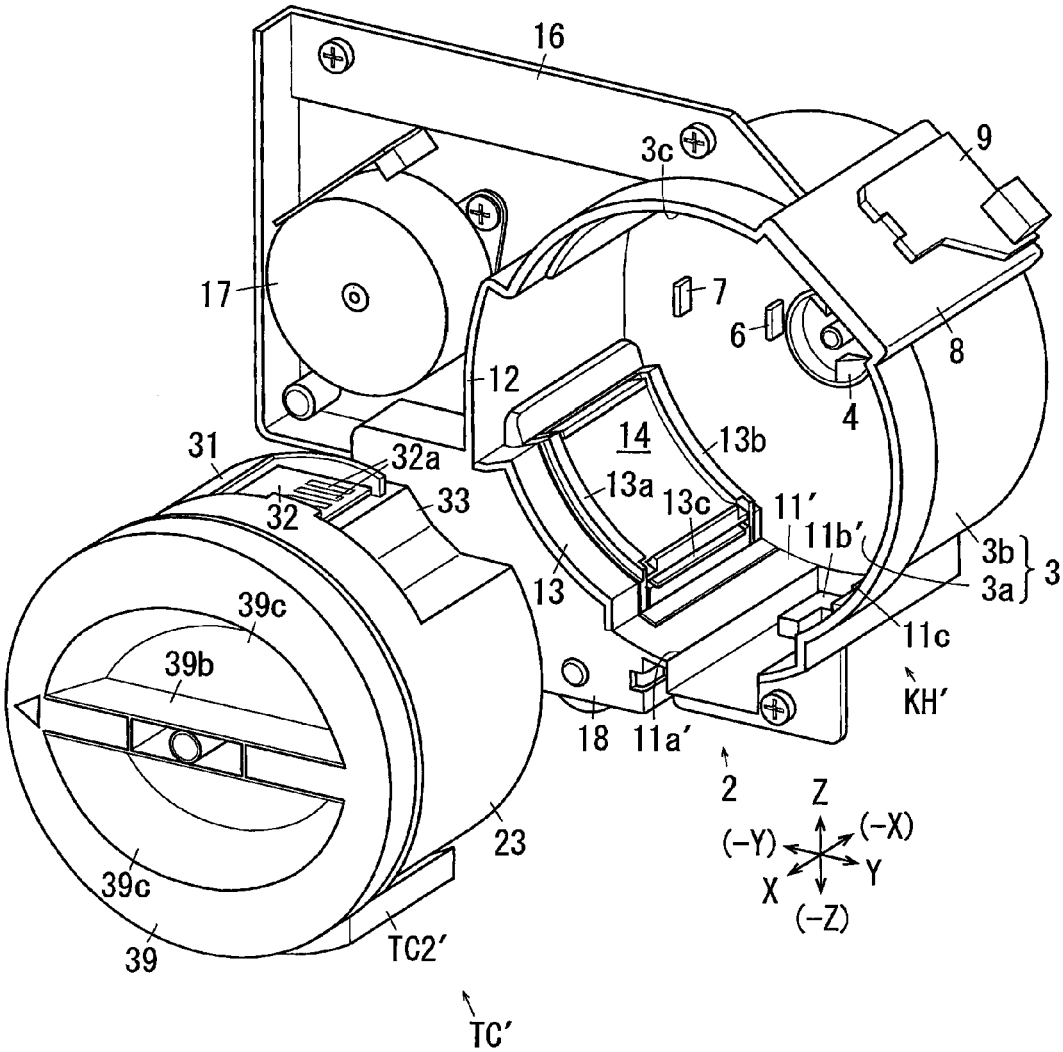
FIGS. 26A and 26B show an important part of the image forming apparatus according to the second embodiment in a state that a toner cartridge is detached from a cartridge holder.
Figure 26B:
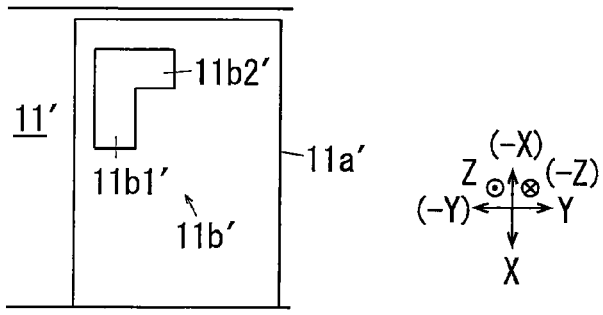

FIG. 25, which corresponds to FIG. 3 (first embodiment), shows a state that the front cover U1*a* of an image forming apparatus according to a second embodiment is opened. FIGS. 26A and 26B show an important part of the image forming apparatus according to the second embodiment in a state that a toner cartridge TC' is detached from a cartridge holder KH'. More specifically, FIG. 26A corresponds to FIG. 5 (first embodiment) and FIG. 26B shows a housing recess 11*a*' of a shutter housing portion 11'.

In describing the second embodiment below, constituent elements having corresponding ones in the first embodiment will be given the same reference symbols as the latter and will not be described in detail. The second embodiment is the same as the first embodiment except for the features described below.

As shown in FIG. 25 and FIGS. 26A and 26B, the cartridge holder KH' (example attachment/detachment subject member) of the second embodiment has the shutter housing portion 11' (example opening/closing member housing portion) instead of the shutter housing portion 11 of the first embodiment. The bottom surface of the shutter housing portion 11' is formed, at the center, with a housing recess 11*a*'. A main body hard key 11*b*' (example restriction member) projects from the bottom surface of the housing recess 11*a*' at a height that is smaller than the depth of the housing recess 11*a*'.

The main body hard key 11*b*' of the second embodiment is formed at a rear-left position in the housing recess 11*a*' of the shutter housing portion 11' to discriminate the toner cartridge TC' corresponding to a printer main body U1'. More specifically, the main body hard key 11*b*' of the first embodiment is generally inverted-L-shaped and has a first restriction portion 11*b*1' which extends in the front-rear direction parallel with a rear portion of the left surface of the housing recess 11*a*' and a second restriction portion 11*b*2' which extends rightward from the rear end of the first restriction portion 11*b*1'.

(Shutter TC2' of Second Embodiment)

Figure 27:
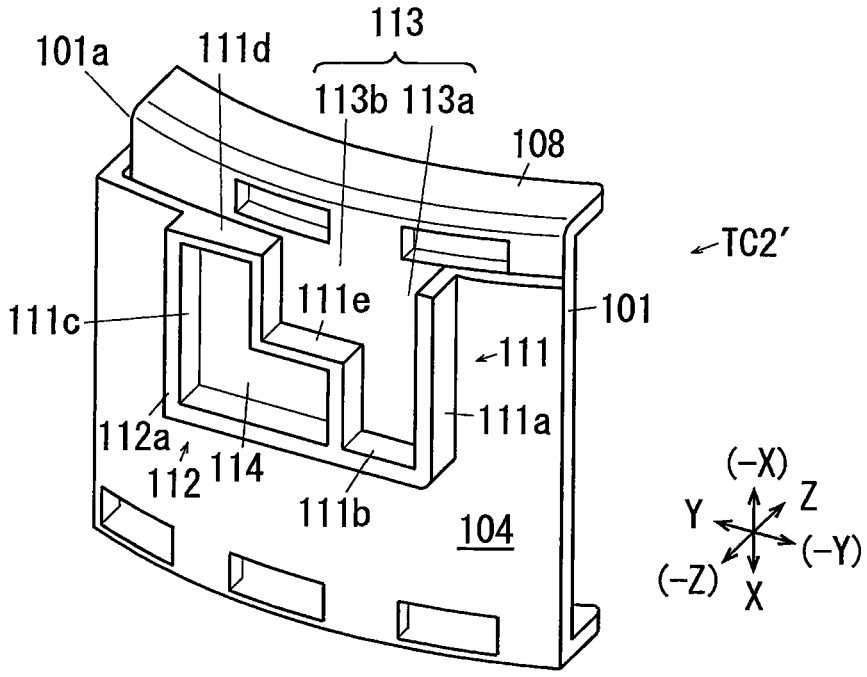
FIG. 27 shows a shutter of the second embodiment.

FIG. 27 shows a shutter TC2' of the second embodiment.

As shown in FIG. 27, the shutter TC2' (example opening/closing member) of the second embodiment has, instead of the shutter plane portion 106 of the first embodiment, a projection 111 which is formed so as to correspond to the back side of the seal support portion 103 and projects outward in the radial direction from the outer surface 104. The height of the projection 111 corresponds to the depth of the housing recess 11*a*' of the shutter housing portion 11' of the cartridge holder KH'. A rectangular shutter plane portion 112 (example plane portion) which extends in the front-rear direction and the right-left direction is formed as an outer plane, in the radial direction, of the projection 111 (bottom plane of the projection 111).

As shown in FIG. 27, the projection 111 is formed with a groove-shaped opening/closing member hard key 113 (example identification portion) which is recessed from the shutter plane portion 112 (with respect to a bottom surface 112*a*).

The opening/closing member hard key 113 of the second embodiment is formed at such a position as to correspond to the main body hard key 11*b*' and is inverted-L-shaped so as to be fitted with the main body hard key 11*b*'. More specifically, the opening/closing member hard key 113 of the second embodiment has a first identification portion 113*a* which is a recess extending parallel with the left sideline of the shutter plane portion 112 and is to be fitted with the first restriction portion 11*b*' and a second identification portion 113*b* which is a recess extending from the rear end of the first restriction portion 11*b*' and is to be fitted with the second restriction portion 11*b*2'.

As shown in FIG. 27, the projection 111 is also formed with a shutter recess 114 (example recess) which is recessed inward (upward in terms of the toner cartridge TC') from the bottom surface 112*a* of the shutter plane portion 112. The shutter recess 114 of the second embodiment is a generally L-shaped recess which is formed in the portion of the projection 111 where the opening/closing member hard key 113 is not formed, that is, on the right of the opening/closing member hard key 113. As a result, the shutter TC2' of the second embodiment is lighter than in a case that the shutter recess 114 is not formed.

As shown in FIG. 27, in the projection 111 of the second embodiment, boundary portions of the opening/closing member hard key 113 and the shutter recess 114 remain as walls. More specifically, a left wall 111*a*, a front wall 111*b*, a right wall 111*c*, and a rear wall 111*d* (shorter than the front wall 111*b*) are formed along the periphery of the projection 111 and a crank-shaped identification wall 111*e* is formed as a boundary between the opening/closing member hard key 113 and the shutter recess 114. The bottom surfaces of the walls 111*a*-111*e* are in the same virtual plane and thus constitute the (bottom) surface 112*a* of the shutter plane portion 112 of the second embodiment.

When the shutter TC2' is placed with the shutter plane portion 112 as a bottom surface, the (bottom) surface 112*a* of the shutter plane portion 112, that is, the bottom surfaces of the walls 111*a*-111*e* serve as bottom surfaces of the shutter TC2' and the posture of the shutter TC2' is kept stable.

(Toner Cartridge TC' and Cartridge Holder KH' of Second Embodiment)

As shown in FIGS. 25-27, when the toner cartridge TC' (example detachable body) of the second embodiment to which the shutter TC2' is attached is inserted into the cartridge holder KH', the shutter TC2' is housed in the shutter housing portion 11' and the projection 111 is housed in the housing recess 11*a*' of the shutter housing portion 11'.

At this time, the main body hard key 11*b*' is fitted into the opening/closing member hard key 113 to complete the attachment of the toner cartridge TC' to the cartridge holder KH'.

The toner cartridge TC' of the second embodiment may be shipped to not only customers in Japan but also overseas customers in Europe, the US, Asia, etc. and may be shipped by OEM (original equipment manufacturing; manufacture as a product of a customer brand). Therefore, the toner cartridge TC' may be used in printer main bodies U1' having different specifications.

That is, even if toner cartridges TC' have the same shape or similar shapes, they may be different from each other in the composition, manufacturing method, melting point, flowability, or the like of a developer contained depending on corresponding printer main bodies U1'. A toner cartridge TC' that is compatible with a certain printer main body U1' may not be compatible with another type of printer main body U1'.

According to the second embodiment, the main body hard key 11*b*' can be formed at the present position in the housing recess 11*a*' of the shutter housing portion 11' of the cartridge holder KH' according to a type of the toner cartridge TC' and the opening/closing member hard key 113 can be formed at the present position in the projection 111 of the shutter TC2'.

As a result, if the types of the printer main body U1' and the toner cartridge TC' correspond to each other, the main body hard key 11*b*' fits into the opening/closing member hard key 113 and the toner cartridge TC' is attached to the printer main body U1'. If the types of the printer main body U1' and the toner cartridge TC' do not correspond to each other, the opening/closing member hard key 113 interferes with the main body hard key 11*b*', that is, the main body hard key 11*b*' hits the rear wall 111*d* or the identification wall 111*e*, and hence the toner cartridge TC' cannot be attached.

(Workings of Embodiment 2)

In the printer U' according to the second embodiment having the above configuration, after the toner cartridge TC' to which the shutter TC2' is attached is attached to the cartridge holder KH', as in the first embodiment the shutter TC2' is opened by rotating the toner cartridge TC'.

The shutter TC2' of the second embodiment is attached to the cartridge main body TC1 by an assembling machine AT'. Since the shutter TC2' of the second embodiment is provided with the shutter plane portion 112 which is different in structure from the shutter plane portion 106 of the first embodiment, as in the first embodiment the posture of the shutter TC2' can be kept stable in the case where it is placed with the shutter plane portion 112 as a bottom surface.

Since the projection 111 of the shutter TC2' of the second embodiment is formed with the opening/closing member hard key 113, the opening/closing member hard key 113 is engaged with the main body hard key 11*b*' and the toner cartridge TC' is attached to the cartridge holder KH' when the toner cartridge TC' is inserted into a corresponding type of printer main body U1'. On the other hand, when the toner cartridge TC' is inserted into another type of printer main body U1', the opening/closing member hard key 113 of the projection 111 interferes with the opening/closing member hard key 113 to prevent erroneous attachment. That is, in the second embodiment, the shutter plane portion 112 also serves as the outer surface of the opening/closing member hard key 113.

(Modifications)

Although the embodiments of the invention have been described above, the invention is not limited to those embodiments and various modifications are possible without departing from the spirit and scope of the invention which are described in the claims. Example modifications (H01)-(H11) to the embodiments will be described below:

(H01) Although each embodiment is directed to the printer as an example image forming apparatus, the invention is not limited to such a case. For example, the invention and can also be applied to a copier, a facsimile machine, or a multifunction machine having all or plural ones of the printer function, copier function, and facsimile function.

(H02) Although each embodiment is directed to the case that the printer U or U' uses a monochrome developer, the invention is not limited to such a case. For example, the invention and can also be applied to a multi-color (two or more colors) image forming apparatus. In this case, the main body hard key 11*b*' and the shutter hard key 113 may be formed according to the color, composition, melting point, flowability, etc. of the developer contained, a customer, etc. of each toner cartridge TC'.

In the embodiments, the plane portion is the shutter plane portion 106 which is a flat surface or the shutter plane portion 112 which is formed by the tip surface of the walls 111*a*-111*e*, the invention is not limited to such cases. The plane portion may have any shape as long as outer ends are arranged in the same virtual plane and the posture of the shutter can be maintained. For example, the outer surface of the shutter may be formed with three legs in such a manner that their outer ends constitute the plane portion.

(H04) Although it is desirable that the shutter plate portion 112 be formed with the shutter recess 114 (example recess), the recess may be omitted. The shutter recess 114 may have any shape such as a circle or a rectangle. Furthermore, the shutter recess 114 is not necessarily required to be a single closed recess; plural recesses may be formed so as to be spaced from each other.

(H05) In the embodiments, it is desirable that the shutter plane portion 106 or 112 be formed so as to correspond to the back side of the seal support portion 103. However, the invention is not limited to such a case. The shutter plane portion 106 or 112 may be formed irrespective of the position of the seal support portion 103.

(H06) In the embodiments, it is desirable that the shutter plane portion 106 or 112 of the shutter TC2 or TC2' be formed at a position that is deviated from the center of the outer surface 104 toward its one end in the circumferential direction. However, the invention is not limited to such a case. The shutter plane portion 106 or 112 may be formed at the center of the outer surface 104 in the circumferential direction.

(H07) In the embodiments, it is desirable that the guide subject walls 107*a* and 108*a* be perpendicular to the shutter plane portion 106 or 112. However, the invention is not limited to such a case. The guide subject walls 107*a* and 108*a* may be not perpendicular to the shutter plane portion 106 or 112.

(H08) In the second embodiment, it is preferable that the shutter plane portion 112 be formed with the opening/closing member hard key 113. However, the opening/closing member hard key 113 may be omitted. On the other hand, although the shutter plane portion 106 of the shutter TC2 of the first embodiment is not formed with a shutter recess 114 (example recess) or an opening/closing member hard key 113 (example identification portion), the shutter plane portion 106 may be formed with a shutter recess 114 or an opening/closing member hard key 113.

(H09) In the first embodiment, it is desirable that the height H1 of the guide subject walls 107*a* and 108*a* (example projections) of the shutter TC2 be larger than the maximum distance H2 between the shutter plate portion 106 and the outer surface 104. However, the invention is not limited to such a case. The height H1 may be smaller than the distance H2. It is desirable that the projections be formed along the front and rear ends of the shutter main body 101 like the guide subject walls 107*a* and 108*a* shown in FIGS. 18A-18C. However, the invention is not limited to such a case. The projections are not limited to walls as long as they project from the inner surface 102 of the shutter main body 101; the projections may be plural pillars or the like. Furthermore, the projections are not necessarily required to be formed along or project from the front and rear ends of the shutter main body 101. The projection(s) may be formed along or on the circumferential center line of the inner surface 102. As such, the projections may be located at any positions and have any shape.

(H10) In the second embodiment, the height H1 of the guide subject walls 107*a* and 108*a* of the shutter TC2' may be set larger than the maximum distance H2 between the shutter plate portion 112 and the outer surface 104.

(H11) Although in the embodiments the toner cartridge TC or TC' is assembled by the assembling machine AT or AT', the invention is not limited to such a case and the toner cartridge TC or TC' may be assembled by any method. For example, the toner cartridge TC or TC' may be assembled manually after the shutter TC2 or TC2' is supplied by the parts feeder PF.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A detachable body comprising:

a detachable body main body that is to be attached to an attachment/detachment subject apparatus in a detachable manner, the detachable main body having an internal space and a connection hole which connects the internal space and an external space; and an opening/closing member that is attached to the detachable body main body, the opening/closing member being movable between an opening position where the connection hole is exposed and a closing position where the connection hole is closed, the opening/closing member comprising: an opening/closing member main body that is curved parallel with a movement direction of the opening/closing member between the opening position and the closing position; and a plane portion comprises a flat surface, the plane portion disposed on an outer surface of the opening/closing member main body.

2. The detachable body according to claim 1, wherein the plane portion is formed with a recess which is recessed inward from the plane portion.

3. The detachable body according to claim 1, further comprising: a sealing member that is capable of sealing the connection hole; and a support portion that is provided on an inner surface of the opening/closing member main body, the support portion supporting the sealing member, wherein the plane portion is formed in the outer surface of the opening/closing member main body at such a position as to correspond to the support portion.

4. The detachable body according to claim 1 further comprising: a projection that projects inward from an inner surface of the opening/closing member main body, the projection having a projection height that is larger than a maximum distance in a projection direction of the projection between the plane portion and the outer surface of the opening/closing member main body.

5. The detachable body according to claim 1, wherein the plane portion is formed at a position that is deviated from the center of the outer surface of the opening/closing member main body toward one end thereof in the movement direction of the opening/closing member.

6. An image forming apparatus comprising: the detachable body according to claim 1 which contains developer inside; and an image forming apparatus main body to which the detachable body is attached in a detachable manner, for forming an image on a medium.

7. The image forming apparatus according to claim 6, wherein the image forming apparatus main body has an attachment/detachment subject member to which the detachable body is to be attached in a detachable manner and a restriction portion which is formed at a preset position in the attachment/detachment subject member so as to correspond to one of plural kinds of detachable bodies; and that the detachable body has an identification portion which is formed at a preset position with respect to the plane portion according to a type of the detachable body, wherein the identification portion allows the detachable body to be attached to the image forming apparatus main body by engaging with the restriction portion if the type of the detachable body and a type of the image forming apparatus main body correspond to each other, and the identification portion prevents the detachable body from being attached to the image forming apparatus main body by interfering with the restriction portion if the type of the detachable body and a type of the image forming apparatus main body do not correspond to each other.

8. The detachable body according to claim 1, wherein the plane portion faces in a radial direction of the opening/closing member.

9. The detachable body according to claim 1, wherein the plane portion is located at a position that is deviated from a center of the outer surface of the opening/closing member main body in the circumferential direction.

* * * * *